US006101348A

United States Patent [19]

Nonaka et al.

[11] Patent Number: 6,101,348

[45] **Date of Patent: *Aug. 8, 2000**

[54] DEVELOPING UNIT, PROCESS CARTRIDGE AND ELECTROPHOTOGRAPHIC IMAGE FORMING APPARATUS

[75] Inventors: Fumito Nonaka, Abiko; Isao Ikemoto, Kashiwa; Akira Higeta; Yoshiyuki Batori, both of Toride, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/021,067

[22] Filed: Feb. 9, 1998

[30] Foreign Application Priority Data

Feb. 10, 1997 [JP] Japan ..... 9-041470
Jun. 27, 1997 [JP] Japan ..... 9-187381

[51] Int. Cl.[7] ..... G03G 15/08

[52] U.S. Cl. ..... 399/103; 399/111

[58] Field of Search ..... 399/102, 103, 399/104, 105, 111; 222/DIG. 1

[56] References Cited

U.S. PATENT DOCUMENTS 4,895,104 1/1990 Yoshino et al. ..... 222/DIG. 1 X
5,229,824 7/1993 Tsusaka et al. ..... 222/DIG. 1 X
5,475,470 12/1995 Sasago et al. .
5,617,579 4/1997 Yashiro et al. .
5,623,328 4/1997 Tsuda et al. .
5,937,237 8/1999 Nonaka et al. ..... 399/106
5,974,288 10/1999 Sato ..... 399/119

*Primary Examiner*—Susan S. Y. Lee
*Attorney, Agent, or Firm*—Fitzpatrick, Cella, Harper & Scinto

[57] ABSTRACT

A developing unit for developing a latent image formed on an electrophotographic photosensitive member, includes a developing member for developing the latent image formed on the electrophotographic photosensitive member with developer, a developer containing member for containing the developer, a supply opening provided in the developer containing member and adapted to supply the developer contained within the developer containing member to the developing member, a seal member for sealably sealing the supply opening, a grip member connected to the seal member and to be gripped when the supply opening is unsealed, a support portion for supporting the grip member, the grip portion being capable of being separated from the support portion by bending the grip member with respect to the support portion, and first and second abutment portions which can abut against each other when the grip member is bent with respect to the support portion to locally generate great stress along a longitudinal direction of a separation portion at which the grip member is separated from the support portion.

39 Claims, 18 Drawing Sheets

DEVELOPING UNIT, PROCESS CARTRIDGE AND ELECTROPHOTOGRAPHIC IMAGE FORMING APPARATUS

BACKGROUND OF THE INVENTION

1. Field of the Invention

The present invention relates to a developing unit, a process cartridge and an electrophotographic image forming apparatus.

The "developing unit" serves to develop a latent image formed on an electrophotographic photosensitive member and incorporates a developing member for developing the latent image formed on the electrophotographic photosensitive member with developer (toner), a developer containing member for containing the developer, a supply opening for supplying the developer contained in the developer containing member to the developing member, a seal member for peelably sealing the supply opening, a grip member to be gripped by an operator when the supply opening is unsealed, and a support portion for supporting the grip member.

The "process cartridge" incorporates therein an electrophotographic photosensitive member and a developing means for developing a latent image formed on the electrophotographic photosensitive member as a cartridge unit which can detachably be mounted to a body of an electrophotographic image forming apparatus, or incorporates therein, in addition to the developing means and the electrophotographic photosensitive member, at least one of a charge member for charging the electrophotographic photosensitive member and a cleaning member for removing developer remaining on the electrophotographic photosensitive member, as a cartridge unit which can detachably be mounted to a body of an electrophotographic image forming apparatus.

The "electrophotographic image forming apparatus" is an apparatus for forming an image on a recording medium by using an electrophotographic image forming system. For example, the electrophotographic image forming apparatus may be an electrophotographic copying machine, an electrophotographic printer (for example, a laser beam printer or an LED printer), an electrophotographic facsimile or an electrophotographic word processor.

2. Related Background Art

A conventional electrophotographic image forming apparatus, such as an electrophotographic copying machine, laser beam printers, or the like, includes a photosensitive drum. Well-known processes such as charging, exposure and development are successively effected regarding the photosensitive drum to thereby form a toner image on the photosensitive drum and transfer the toner image onto a recording medium. Thereafter, residual toner remaining on the photosensitive drum is removed by a cleaning device. In this way, the image is formed.

In such electrophotographic image forming apparatuses, recently, a process cartridge has been adopted to make the apparatus compact and simplify its maintenance. In the process cartridge, the photosensitive drum and the process means (such as a charge means, a developing means and a cleaning means) acting on the photosensitive drum are integrally incorporated as a cartridge unit, which can detachably be mounted to a body of the image forming apparatus by an operator himself.

In conventional developing units or process cartridges, an opening portion of a toner container containing toner (developer) is sealed by a toner sealing seal member to block a path between the toner container and a developing chamber. Before the process cartridge is used, the operator grips a grip to which one end of the seal member is secured and which is integrally formed with the toner container and separates the grip from the toner container by repeating several or several tens of reciprocal bendings of the grip around a weakened line between the grip and the toner container. Thereafter, the toner sealing seal member is unsealed from the opening portion by pulling the seal member by hand.

SUMMARY OF THE INVENTION

An object of the present invention is to provide a developing unit and a process cartridge, in which a grip member can easily be separated from a support portion supporting the grip member, and an electrophotographic image forming apparatus to which such a process cartridge can detachably be mounted.

Another object of the present invention is to provide a developing unit and a process cartridge which can detachably be mounted to an electrophotographic image forming apparatus, and an electrophotographic image forming apparatus to which such a process cartridge can detachably be mounted, which developing unit, process cartridge and electrophotographic image forming apparatus include (a) a developing member for developing a latent image formed on an electrophotographic photosensitive member with developer, (b) a developer containing member for containing the developer, (c) a supply opening provided in the developer containing member and adapted to supply the developer contained within the developer containing member to the developing member, (d) a seal member for sealably sealing the supply opening, (e) a grip member connected to the seal member and to be gripped when the supply opening is unsealed, (f) a support portion for supporting the grip member, the grip portion being capable of being separated from the support portion by bending the grip member with respect to the support portion, and (g) first and second abutment portions which can abut against each other when the grip member is bent with respect to the support portion to locally generate great stress along a longitudinal direction of a separation portion at which the grip member is separated from the support portion.

The other objects and features of the present invention will be apparent from the following detailed explanation of the invention referring to the accompanying drawings.

DETAILED DESCRIPTION OF PREFERRED EMBODIMENTS

The present invention will now be explained in connection with embodiments thereof with reference to the accompanying drawings.

First Embodiment

A process cartridge and an image forming apparatus to which such a process cartridge can detachably be mounted will be fully explained with reference to FIGS. 1 to 4.

First of all, the entire constructions of the process cartridge and the image forming apparatus using such a process cartridge will be explained, and then, a grip for unsealing a developer sealing seal member (also referred to as "toner seal" hereinafter) will be explained.

(Entire Construction)

Figure 3:
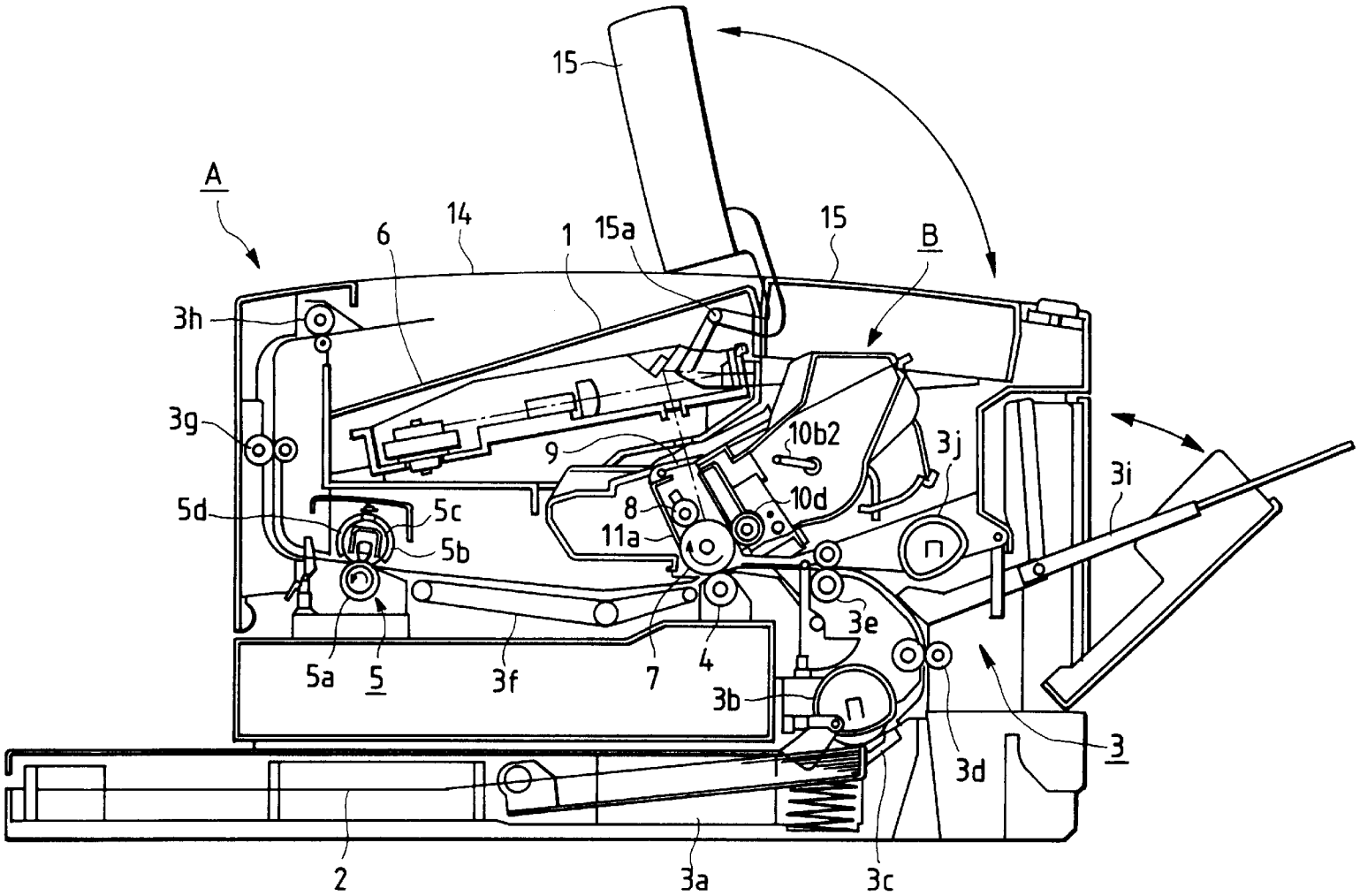
FIG. 3 is an elevational sectional view of an image forming apparatus.

As shown in FIG. 3, in an electrophotographic image forming apparatus (laser beam printer) A, a latent image is formed on a photosensitive drum (drum-shaped electrophotographic photosensitive member) 7 by illuminating a photosensitive drum 7 with information light corresponding to image information from an optical system 1, and then developing the latent image with developer (referred to as "toner" hereinafter) to form a toner image. In synchronism with the formation of the toner image, recording media 2 are separated and supplied one by one from a sheet supply cassette 3*a* by means of a pick-up roller 3*b* and urging member 3*c* urged against the pick-up roller. The separated recording medium 2 is conveyed by a convey means 3 comprised of a pair of convey rollers 3*d* and a pair of regist rollers 3*e*. Then, the toner image formed on the photosensitive drum 7 of a process cartridge B is transferred onto the recording medium 2 by applying voltage to a transfer roller (transfer means) 4. Thereafter, the recording medium 2 is sent to a fixing means 5 through a convey belt 3*f*. The fixing means 5 includes a drive roller 5*a*, and a fixing rotary member 5*d* formed from a cylindrical sheet having a heater 5*a* therein and rotatably supported by a support 5*c*. While the recording medium 2 is passing between the roller 5*a* and the fixing rotary member 5*d*, heat and pressure are applied to the recording medium, to thereby fix the toner image to the recording medium. Thereafter, the recording medium 2 is conveyed through a reverse rotation path by means of pairs of discharge rollers 3*g*, 3*h* and is discharged onto a discharge tray 6. Incidentally, in the image forming apparatus A, manual sheet insertion supply can be permitted by providing a manual insertion tray 3*i* and a manual insertion roller 3*j*.

(Process Cartridge)

Figure 4:
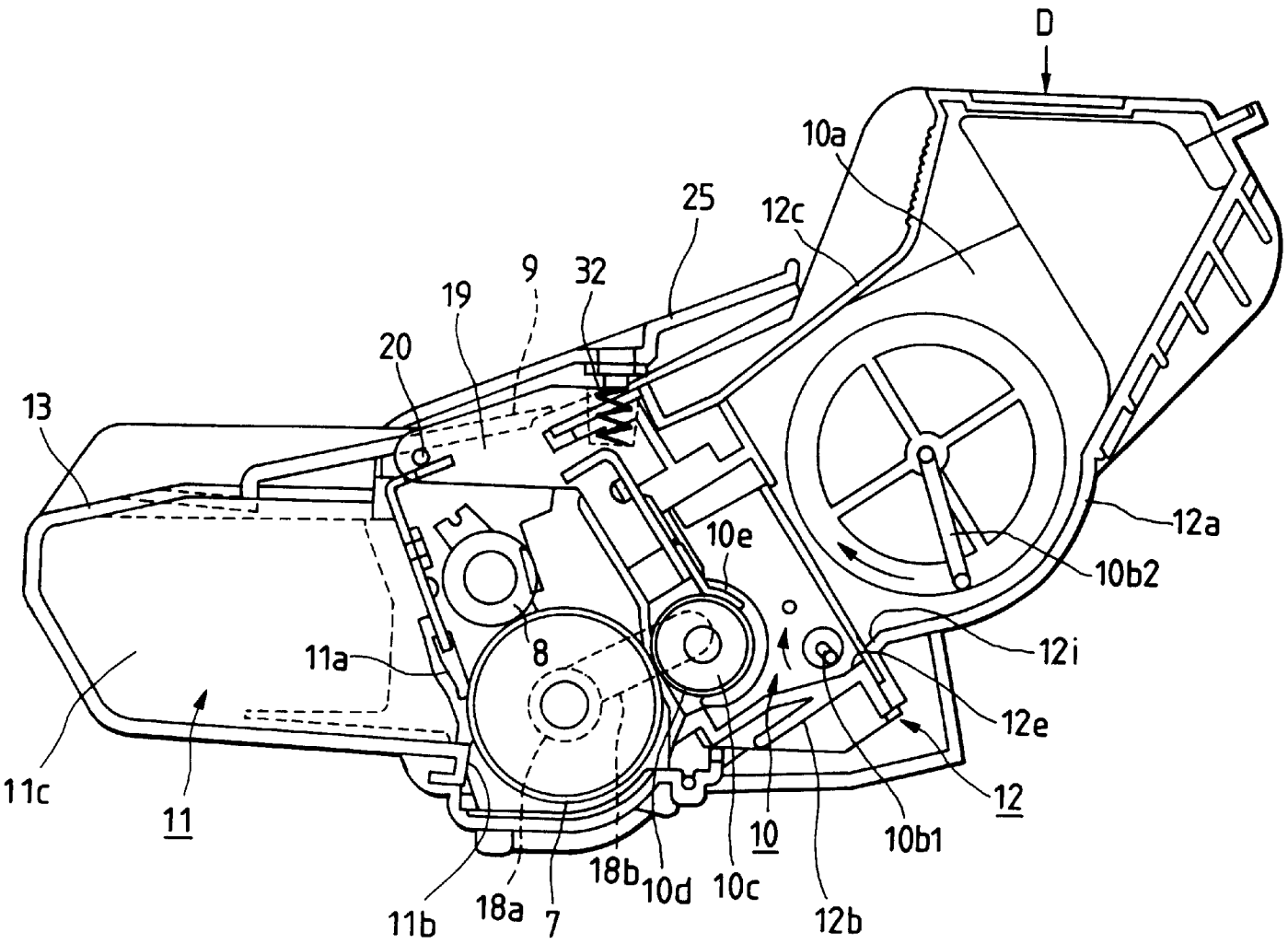
FIG. 4 is an elevational sectional view of the process cartridge.

The process cartridge B includes the electrophotographic photosensitive drum 7 and at least one process means. The process means may be, for example, a charge means for charging the electrophotographic photosensitive drum, a developing means for developing a latent image formed on the electrophotographic photosensitive drum and/or a cleaning means for removing the residual toner remaining on the electrophotographic photosensitive drum. As shown in FIG. 4, in the process cartridge B according to the illustrated embodiment, the photosensitive drum 7 having a photosensitive layer is rotated and is uniformly charged by applying voltage to a charge roller (charge means) 8. Then, a latent image is formed by illuminating image light from an optical system 1 onto the photosensitive drum 7 through an exposure opening 9, and the latent image is developed by a developing means 10.

In the developing means 10, the toner contained in a toner containing portion 10*a* is sent into a developing frame 12*b* through an opening portion 12*i* of a toner frame 12*a* (formed as a toner container) and an opening portion 12*e* of the developing frame 12*b* by means of a rotatable toner feed member (toner feed member) 10*b*2 disposed within the toner containing portion 10*a*. The toner is agitated by a toner agitating member 10*b*1. While a developing roller (developing rotary member) 10*d* having a fixed magnet 10*c* therein is being rotated, a toner layer is formed on a surface of the developing roller 10*d* by applying a frictional charge by means of a developing blade 10*e*, and the toner on the toner layer is transferred onto the latent image on the photosensitive drum 7, to thereby form a latent image.

The toner image is transferred onto the recording medium 2 by applying voltage having a polarity opposite to that of the toner image to the transfer roller 4. Thereafter, residual toner remaining on the photosensitive drum 7 is removed by a cleaning means 11 comprising a cleaning blade 11*a* for scraping the residual toner on the photosensitive drum, a dip sheet 11*b* for receiving the scraped toner and a waste toner containing portion 11*c* for collecting the waste toner.

Various members such as the photosensitive drum 7 are contained in a cartridge frame as a unit which can detachably be mounted to a cartridge mounting means of the image forming apparatus. The cartridge frame is formed by joining a developing unit D (obtained by welding together the toner frame 12*a* including the toner containing portion 10*a* and supporting the toner feed member 10b2 for rotational movement, the developing frame 12b holding developing members such as the toner agitating member 10b1, the developing roller 10d and the developing blade 10e, and a lid member 12c) and a cleaning frame 13 including the waste toner containing portion 11c and holding the photosensitive drum 7, the cleaning blade 11a, the dip sheet 11b and the charge roller 8.

Explaining the cartridge mounting means, when an open/close member 15 is opened around a shaft 15a, a space of the cartridge mounting portion is exposed. Cartridge mount guide members (not shown) are disposed on left and right sides of the cartridge mounting portion, and the process cartridge B is mounted to the image forming apparatus by guiding guides (comprised of bosses 18a and ribs 18b) of the process cartridge B along the cartridge mount guide members.

(Jointed Portion between Toner Frame and Developing Frame)

Figure 27:
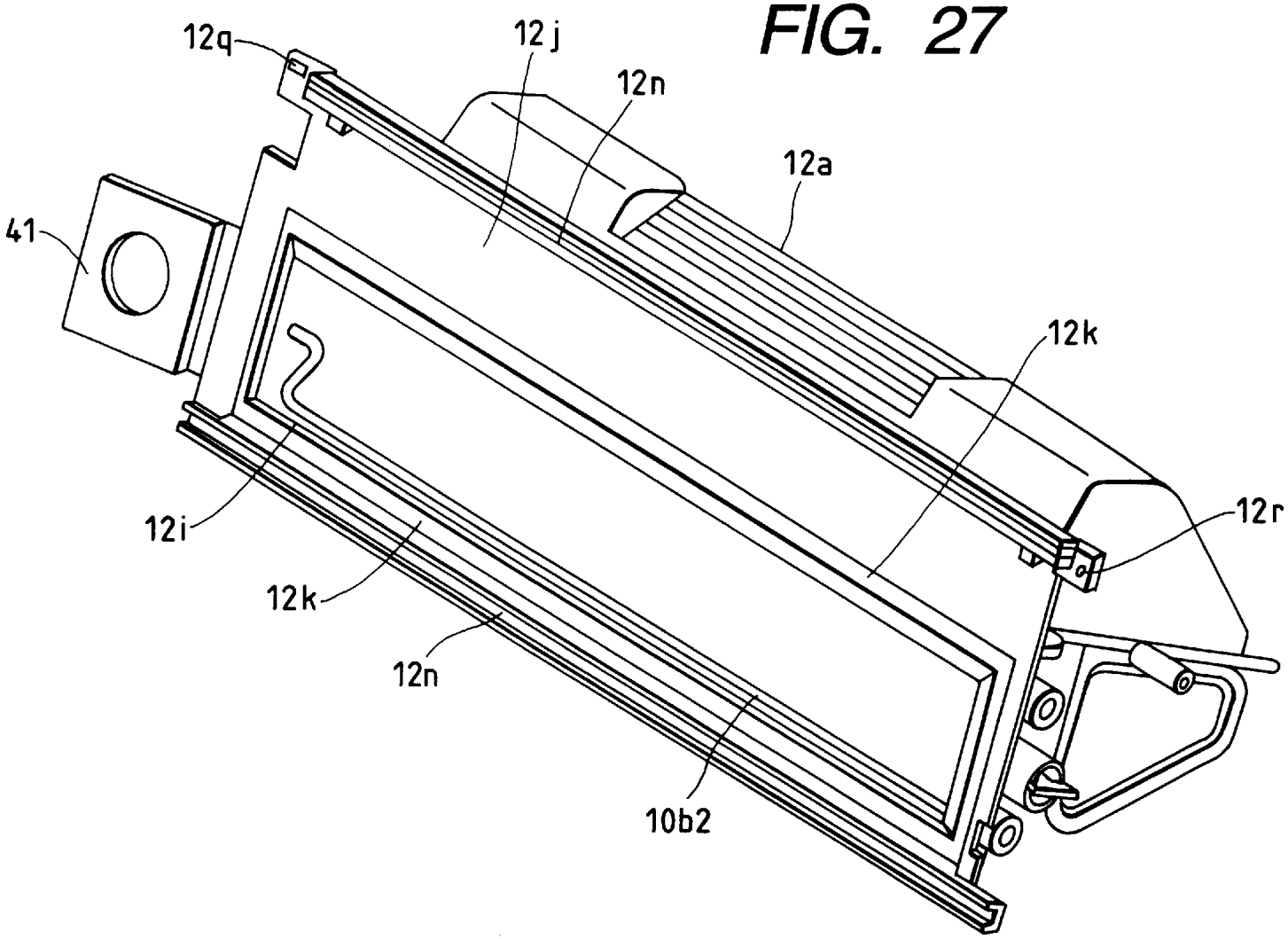
FIGS. 27 and 28 are perspective views of a toner frame.

As shown in FIGS. 4 and 27, the opening portion 12i for feeding the toner from the toner frame 12a to the developing frame 12b is provided at a jointed portion between the toner frame (toner containing portion) 12a and the developing frame (developing means portion) 12b. Around the opening portion 12i, a recessed surface 12k is formed, and parallel longitudinal grooves 12n are formed in upper and lower edges of upper and lower flanges 12j defining the recessed surface. Incidentally, the "longitudinal direction" is a horizontal direction perpendicular to a recording medium conveying direction.

Figure 26:
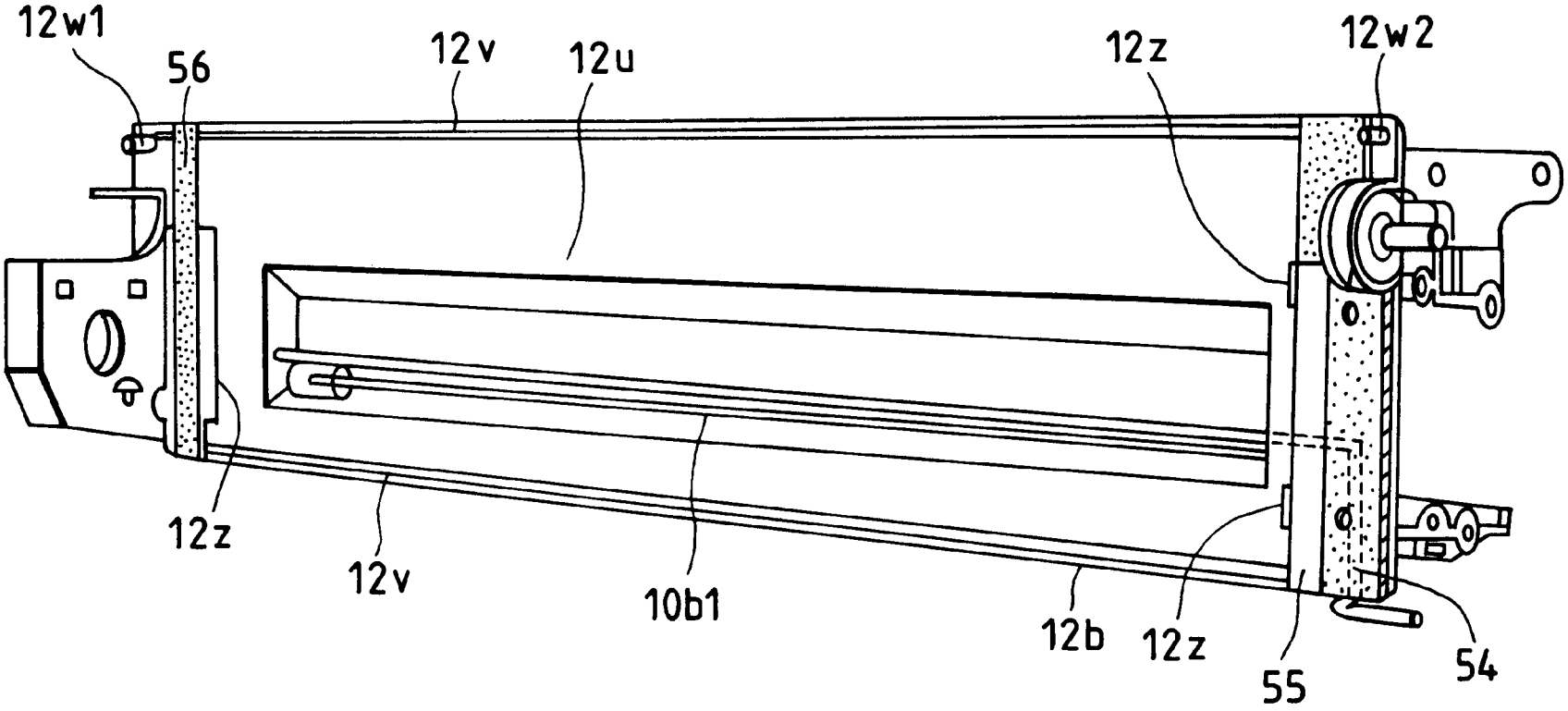
FIG. 26 is a perspective view of a developing frame.

As shown in FIG. 26, a surface of the developing frame 12b opposed to the toner frame 12a is constituted by a flat flange 12u, and longitudinal projections or ridges 12v to be fitted into the grooves 12n of the toner frame 12a are formed on upper and lower edges of the flange 12u. Triangular projections (not shown) for supersonic welding are formed on the ridges. After various members are assembled in the frames, the toner frame 12a and the developing frame 12b are welded together by fitting the ridges 12v of the developing frame 12b into the grooves 12n of the toner frame 12a and then by effecting supersonic welding along the longitudinal direction.

Figure 28:
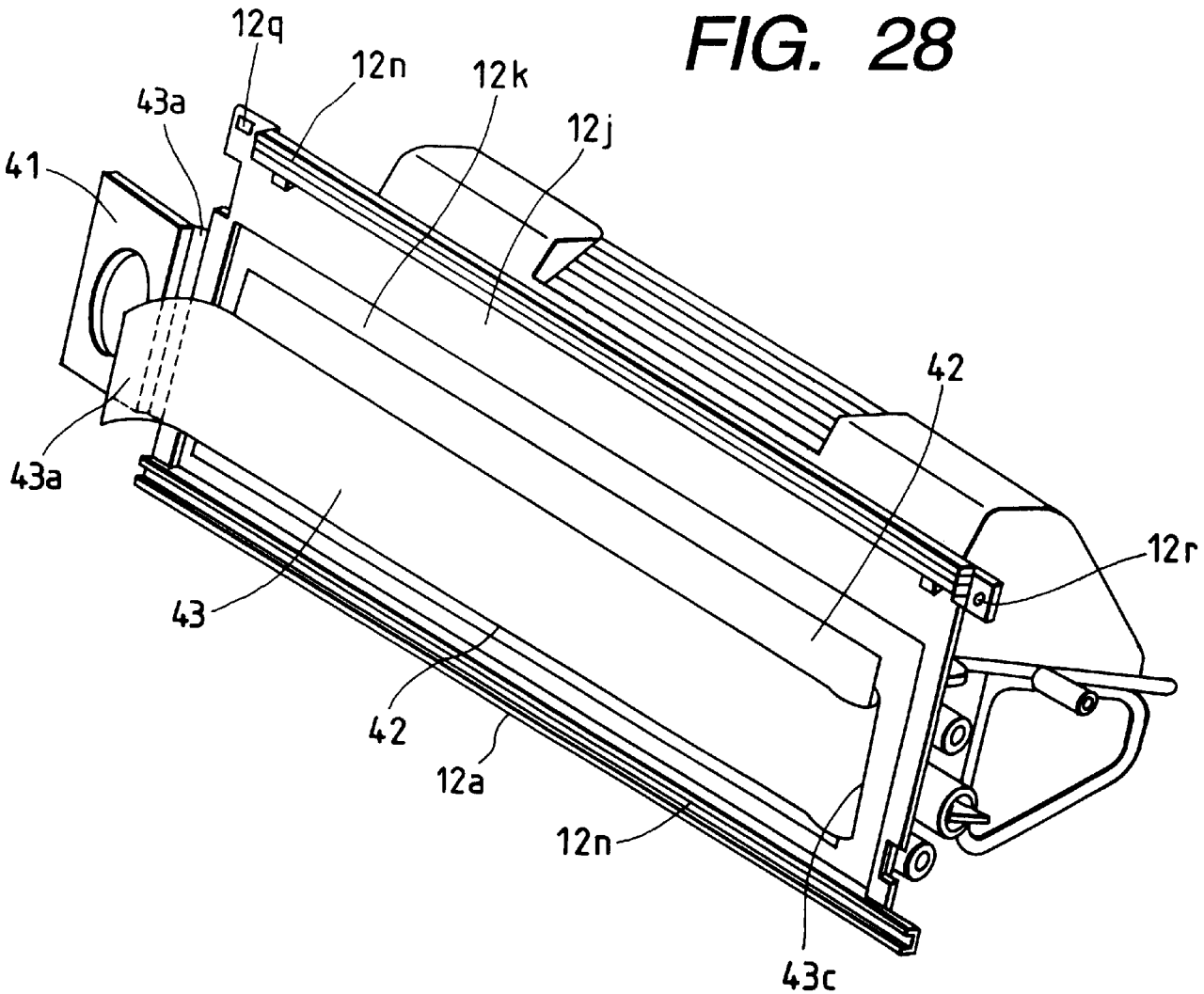

As shown in FIG. 28, a toner seal cover film 42 which can easily be torn along a longitudinal direction is adhered to the recessed surface 12k of the toner frame 12a along four edge portions of the opening portion 12i to close the opening portion 12i. A tear tape 43 for tearing the cover film 42 to open or unseal the opening portion 12i is adhered to the cover film 42. The tear tape 43 is folded back at one longitudinal end 43c of the opening portion 12i and is extended externally through the area between the toner frame 12a and an elastic seal member 54 (refer to FIG. 26) such as felt or foam rubber adhered to a longitudinal end portion of a flat surface of the developing frame 12b opposed to the toner frame 12a. A grip (to be gripped by an operator) 41 is attached to an exposed end 43a of the tear tape 43 (refer to FIGS. 1, 5 and 28). The grip 41 is integrally formed with one longitudinal end of the flange 12j of the toner frame 12a to be connected to the toner frame via a weakened portion (through which the grip can be separated from the toner frame). A synthetic resin film tape 55 having a low coefficient of friction is adhered to an inner portion of the seal member 54. Further, an elastic seal member 56 (FIG. 26) is adhered to the other longitudinal end of the developing frame opposite to the elastic seal member 54.

The elastic seal members 54, 56 are adhered to the flange 12u at both longitudinal ends thereof along the entire width thereof. The elastic seal members 54, 56 are aligned with the flange 12j of the recessed surface 12k of the toner frame 12a at both longitudinal end thereof and overlap the longitudinal end flange portions 12j and the ridges 12v along the entire width thereof.

In order to facilitate the positioning of the frames 12a, 12b when the toner frame 12a and the developing frame 12b are jointed together, a circular hole 12r and a square hole 12q (into which a cylindrical projection 12w1 and a prismatic projection 12w2 are to be fitted) are formed in the flange 12j of the toner frame 12a. The projection 12w1 is closely fitted into the circular hole 12r, and the prismatic projection 12w2 is closely contacted with the square hole 12q in the width-wise direction, but is loosely received in the square hole in the longitudinal direction.

Figure 1:
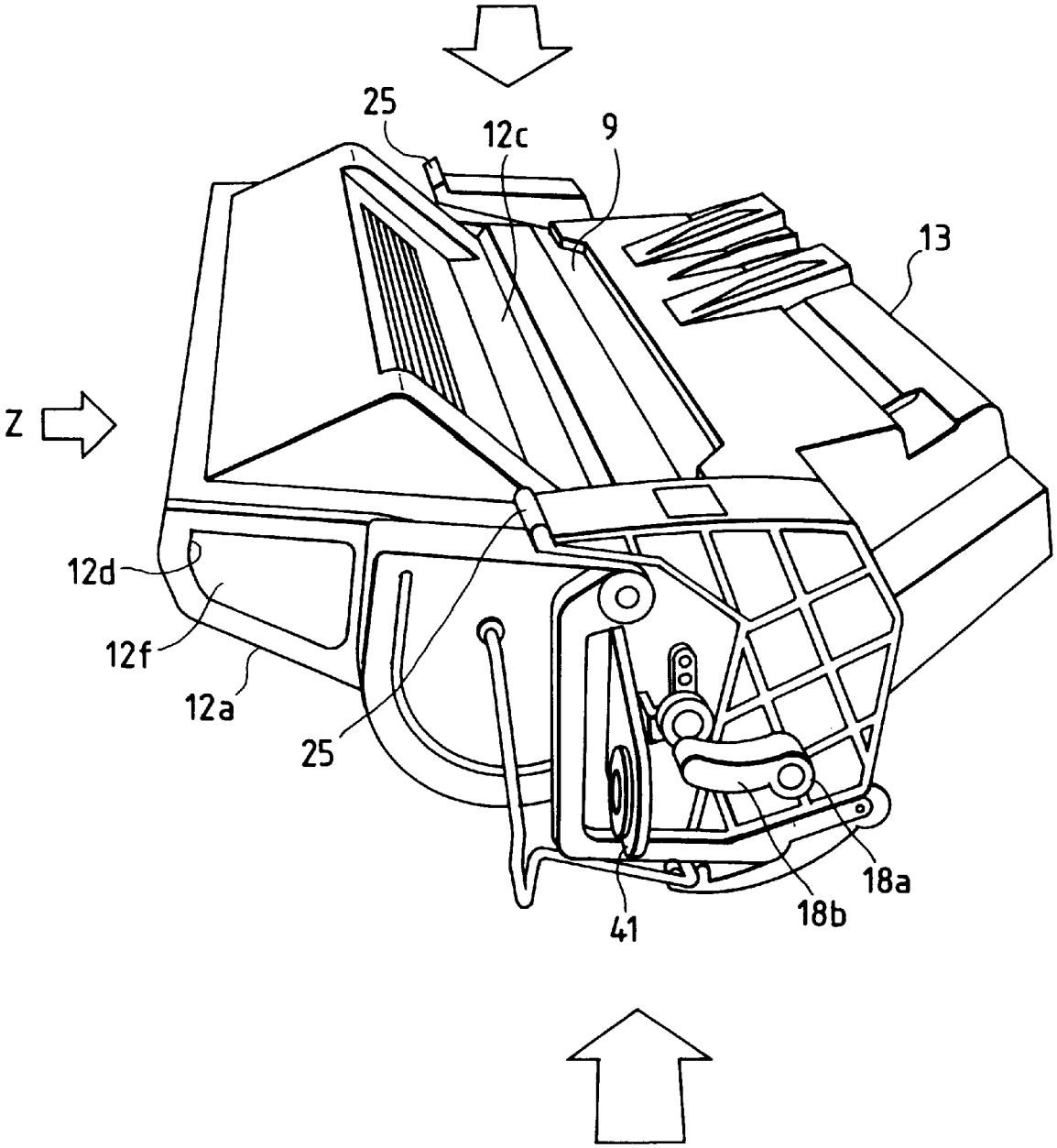
FIG. 1 is a perspective view showing a right side surface of a process cartridge according to a preferred embodiment of the present invention.
Figure 2:
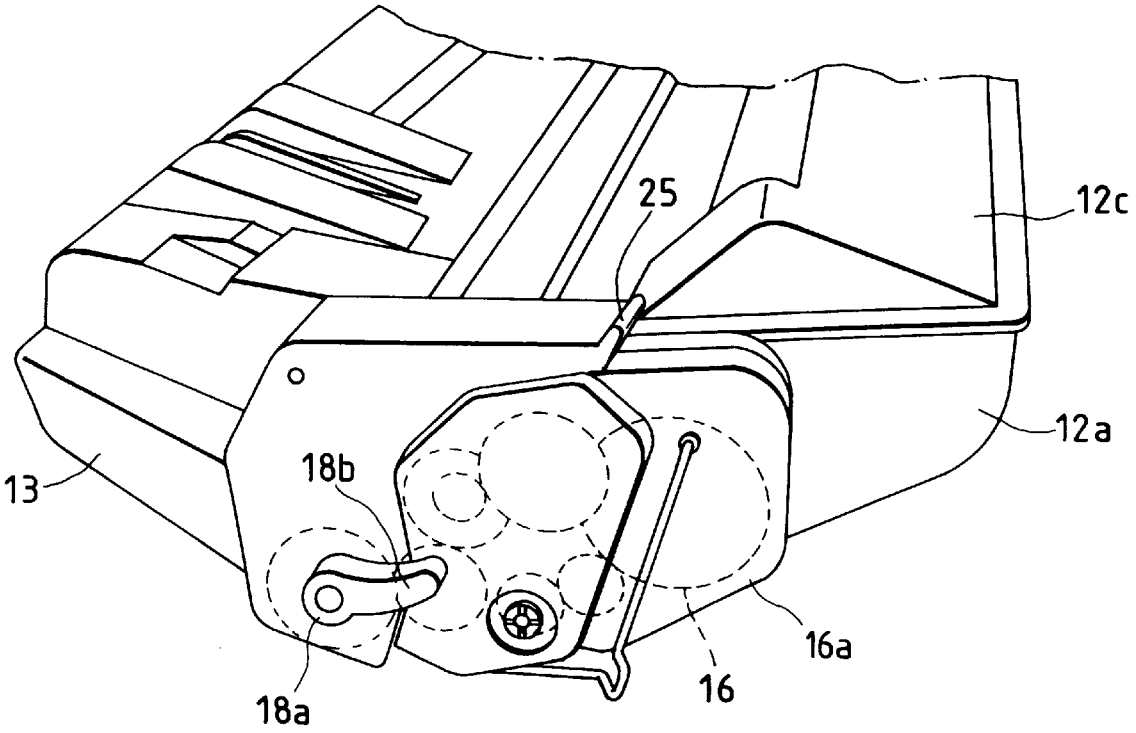
FIG. 2 is a perspective view showing a left side surface of the process cartridge according to a preferred embodiment.

When the toner frame 12a and the developing frame 12b are joined together, the toner frame 12a and the developing frame 12b are assembled independently. During the assembling, after the opening portion 12i of the toner frame 12a is sealed by using the cover film 42 and the tear tape 43 as the toner seal, the toner is loaded through a toner loading opening 12d and the toner loading opening 12d is closed by a toner cap 12f (FIG. 1). Thereafter, the positioning cylindrical projection 12w1 and prismatic projection 12w2 of the developing frame 12b are fitted into the positioning circular hole 12r and square hole 12q of the toner frame 12a and the ridges 12v of the developing frame 12b are fitted into the grooves 12n of the toner frame 12a. Then, when the toner frame 12a and the developing frame 12b are compressed together, the elastic seal members 54, 56 are compressed by the longitudinal end flange portions 12j of the toner frame 12a, with the result that width-wise projections (spacers) 12z provided on both longitudinal end of the flange 12 of the developing frame 12b approach the flange 12j of the toner frame 12a. The width-wise projections 12z are disposed on both sides of the tear tape 43 in the width-wise direction to permit the passage of the tear tape 43.

Figure 29:
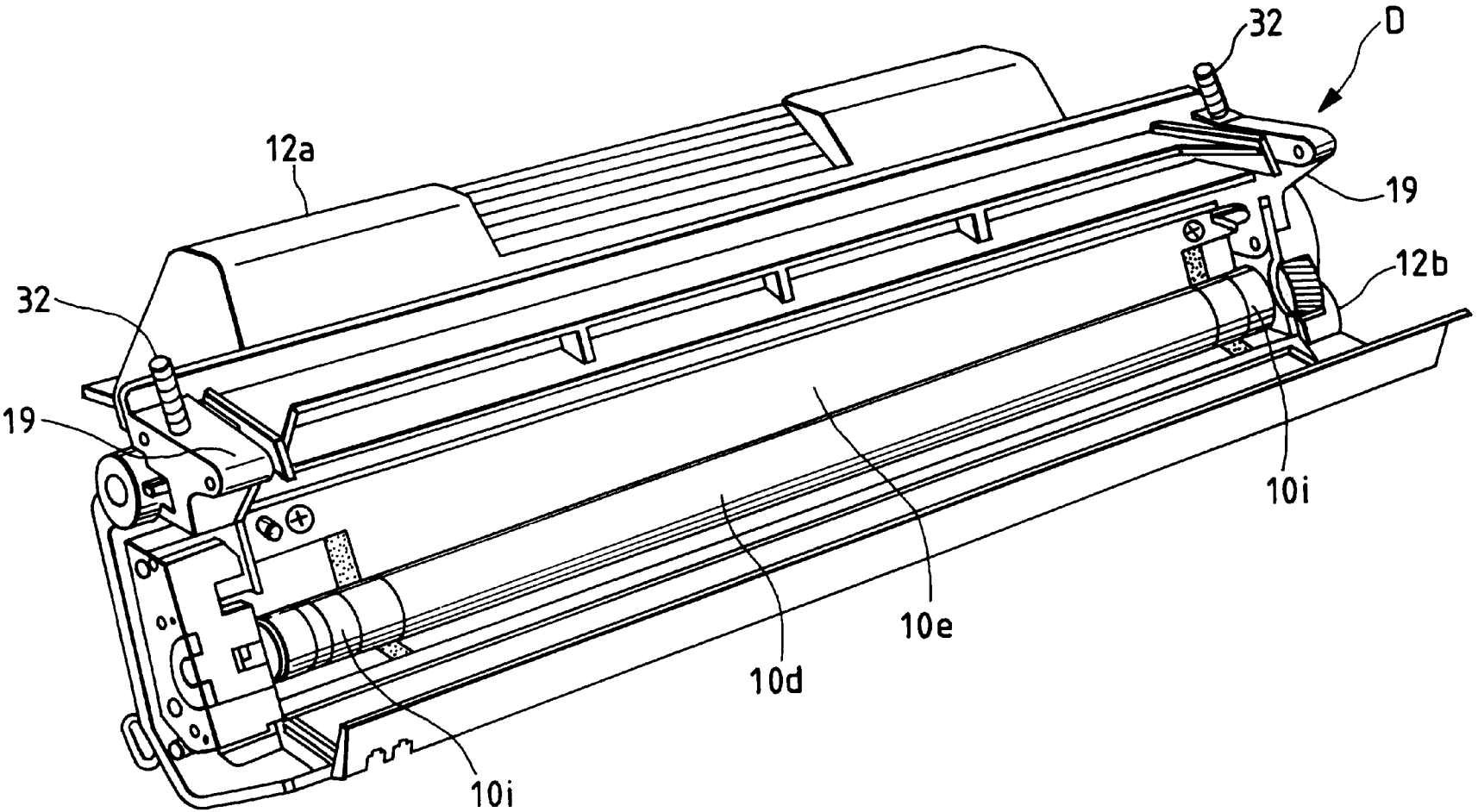
FIG. 29 is a perspective view of a developing unit.

In this condition, supersonic vibration is applied between the ridges 12v and the grooves 12n while compressing the toner frame 12a and the developing frame 12b together, so that the triangular projections provided on the ridges 12v are melted and are adhered to the bottom of the grooves 12n. Consequently, the edges of the grooves 12n of the toner frame 12a and the spacer projections 12z of the developing frame 12b closely contact with the corresponding portions, so that a closed or sealed space is defined between the recessed surface 12k of the toner frame 12a and the opposed flat surface 12u of the developing frame 12b. The cover film 42 and the tear tape 43 are contained within this space. In this way, the developing unit D as shown in FIG. 29 is completed.

As the toner seal, other than the toner seal comprising the cover film and the tear tape, a toner seal of the easy peel type, comprised of a single folded sheet, may be applied to the present invention.

In such a developing unit D, an arm portion 19 protruding toward the cleaning frame 13 is provided on the developing frame 12b. As shown in FIG. 4, a tip end of the arm portion 19 and the cleaning frame 13 are pivotally interconnected by a pin 20. A compression coil spring 32 is disposed between an arm portion 25 of the cleaning frame 13 protruded toward the developing unit D and the developing frame 12b to urge the developing roller 10d toward the photosensitive drum 7. As shown in FIG. 29, spacer rollers 10i each having a diameter greater than that of the developing roller 10d are provided on both ends of the developing roller 10d outside an image forming area thereof, so that the spacer rollers 10i are urged against the photosensitive drum 7 to form a gap of about 300 μm between the photosensitive drum 7 and the developing roller 10*d* at the image forming area.

In order to feed the toner contained in the toner frame 12*a* to the developing frame 12*b*, first of all, a root of the grip 41, to which the end 43*d* of the tear tape 43 protruded externally of the process cartridge B is adhered, is separated from or torn (by bending) from the toner frame 12*a*. Thereafter, by pulling the grip 41, tear tape 43 is drawn from the process cartridge to tear the cover film 42, to thereby unseal or open the opening portion 12*i*. As a result, the toner can be fed from the toner frame 12*a* to the developing frame 12*b*. In this case, the elastic seal members 54, 56 are elastically deformed at both longitudinal flange portions 12*j* of the toner frame 12*a* while keeping the flat parallelepiped configuration to maintain a good sealing ability.

Since the opposed surfaces of the toner frame 12*a* and the developing frame 12*b* are formed as mentioned above, when a force for tearing the cover film 42 is applied to the tear tape 43, the tear tape 43 can be drawn from between the frames 12*a* and 12*b* smoothly. Incidentally, material forming the toner frame 12*a* and the developing frame 12*b* may be plastic such as polyethylene, ABS resin (acrylonitrile-butadiene-styrene copolymer), polycarbonate, polyethylene or polypropylene.

(Toner Seal Grip)

Figure 5:
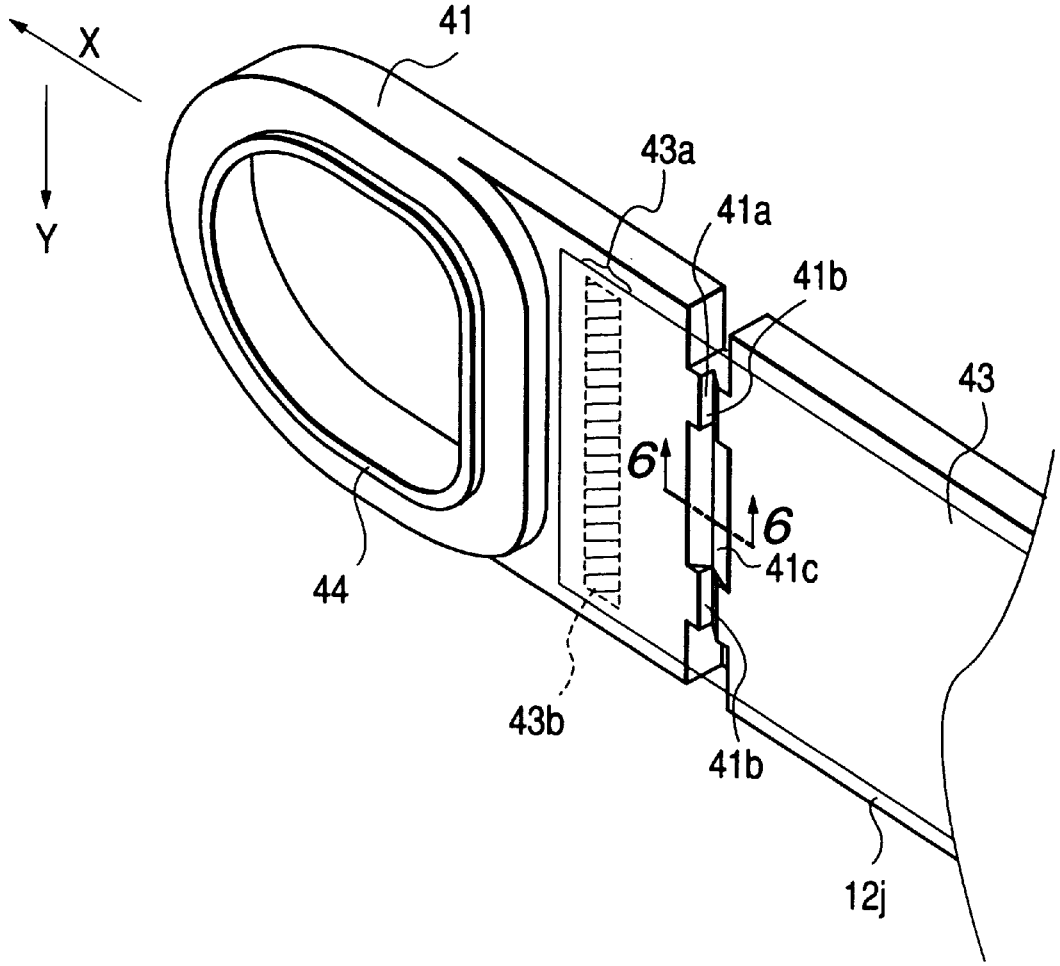
FIG. 5 is a perspective view of a toner seal drawing grip according to a first embodiment of the present invention.

The grip for the toner seal member will be described with reference to FIG. 5.

In order to supply the toner from the toner frame (developer containing portion) 12*a* to the developing frame (developing means portion) 12*b*, the tear tape 43 must be drawn in a direction shown by the arrow X to unseal the toner seal. The end 43*d* of the tear tape 43 is secured to the grip 41 by a securing means 43*b* such as a two-faced adhesive tape or hot melt adhesive, and the grip is integrally formed with the flange 12*j* of the toner frame 12*a*. The grip 41 is provided with a hole through which a finger of the operator can be inserted. A protection member 44 made of resin material is provided within the hole.

Figure 6:
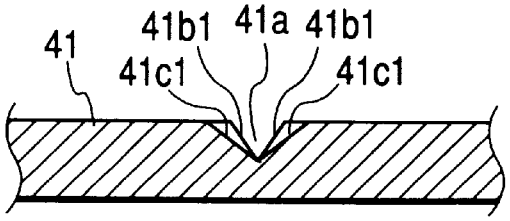
FIG. 6 is a sectional view taken along the line 6—6 in FIG. 5.
Figure 7:
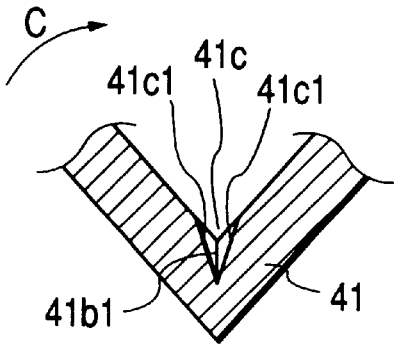
FIG. 7 is a sectional view taken along the line 6—6 in FIG. 5 showing a function of a portion shown in FIG. 5.

A notched portion (weakened portion) 41*a* around which the grip is bent is provided in the grip 41 at a portion of the grip to which the tear tape 43 is adhered. The notched portion 41*a* has narrower notch portions 41*b* and a wider notch portion 41*c*. As shown in FIG. 6, the narrower notch portions 41*b* and the wider notch portion 41*c* are constituted by grooves so that the width of an open top of the wider notch portion 41*c* is greater than the width of an open top of each narrower notch portion 41*b*. In the illustrated embodiment, the depth of the wider notch portion is the same as a depth of each narrower notch portion.

Figure 8:
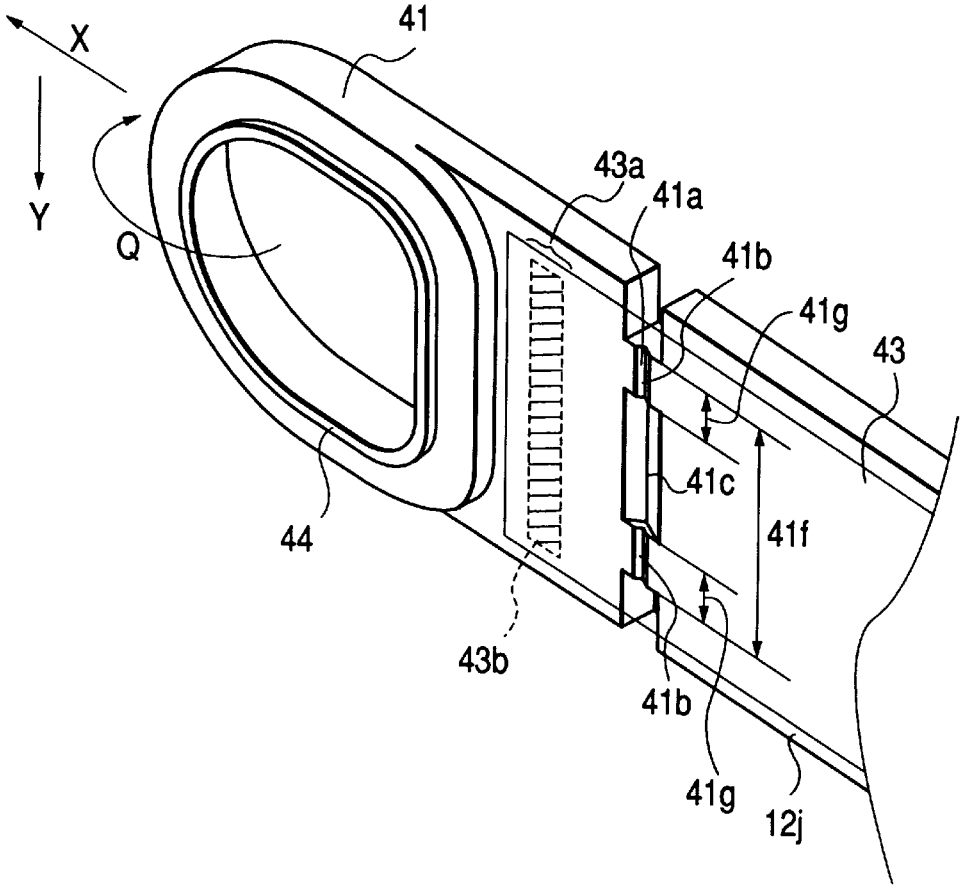
FIG. 8 is a perspective view of the grip according to the first embodiment in which a depth of a notch is not uniform.

However, the present invention is not limited to the fact that the depth of the wider notch portion is the same as the depth of each narrower notch portion, but, as shown in FIG. 8, the depth of each narrower notch portion 41*b* may be smaller than the depth of the wider notch portion 41*c*. In this case, the grip 41 is previously bent around the notched portion 41*a* in a direction Q (toward a surface opposite to the surface in which the notched portion is formed) by 90 degrees. As a result, cracks are created from bottoms of the grooves of the narrower notch portions 41*b* to the depth of a bottom of the groove of the wider notch portion 41*c*, to thereby obtain the same effect as the notch portions having the same depths as shown in FIG. 5.

In the illustrated embodiment, the grip 41 is formed from a generally flat plate connected to the flange 12*j* of the toner frame 12*a* via the notched portion 41*a*. The distance between the bottom of the notched portion 41*a* and the opposite surface opposite to the surface, in which the notched portion is formed is small.

Figure 9:
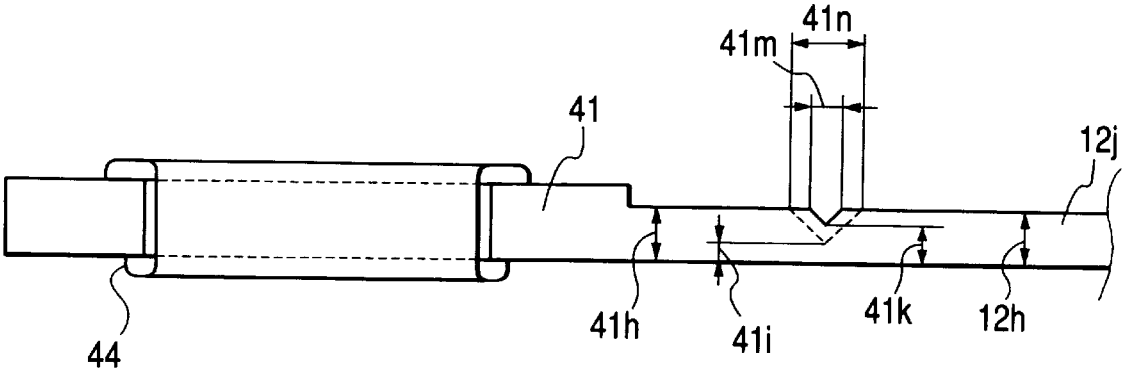
FIG. 9 is a sectional view of the grip of FIG. 8.

In FIG. 9 (the tape 43 is omitted from illustration), the thickness 41*h* of the grip 41*i* and the thickness 12*h* of the flange 12*j* of the toner frame 12*a* are selected be 1.5 mm, the distance (minimum thickness) between the bottom of the wider notch portion 41*c* and the opposite surface is selected to be 0.5 mm, and the distance (minimum thickness) between the bottom of each narrower notch portion 41*b* and the opposite surface is selected to 1 mm.

The minimum thickness at the bottom of the notched portion is determined in consideration of molten flow during the molding and prevention of damage of the notched portion due to shock during transportation. Width 41*m*, 41*n* of the open top of the notched portion are preferably selected to be the minimum while considering the durability during the molding.

Incidentally, while a cross-section of each narrower notch portion 41*b* was illustrated as a "V-shaped" groove, in actual practice, the cross-section is not a V-shaped groove. That is to say, the opposed surface of the V-shaped is constituted by a curved surface convex to the other surface, and the angle between tangential lines to the opposed curved surfaces in a plane perpendicular to the V-shaped groove is gradually increased from the bottom to the open top of the narrower notch portion (similar to the explanation hereinbelow).

In the case where the grip 41 is bent, when the grip 41 is bent toward the tear tape 43, the opposed surfaces 41*b*1 of the V-shaped grooves of the narrower notch portions 41*b* abut against each other, but the opposed surfaces 41*c*1 of the V-shaped groove of the wider notch portion 41*c* do not abut against each other. Thus, the stress is concentrated at the minimum thickness portions of the narrower notch portions 41*b*, thereby facilitating the tearing of the narrower notch portions.

Figure 10:
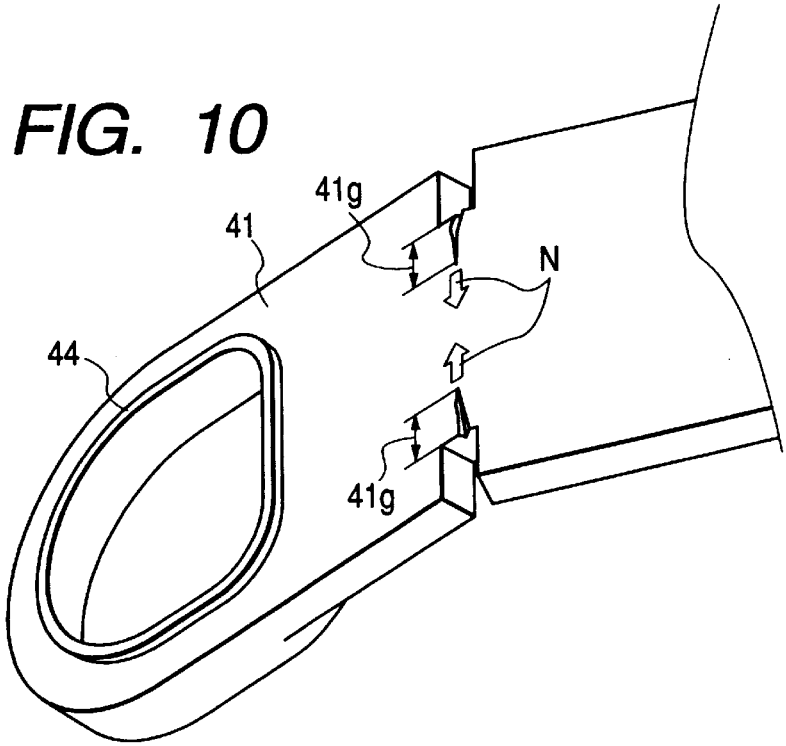
FIG. 10 is a schematic perspective view showing a condition in which initial cracks are generated.

Further, since the smaller the length 14*g* (in a direction Y) of each narrower notch portion 41*b*, the greater the resistance to a bending force when the grip 41 is bent by the bending force, the bending force is supported by the shorter portions of the narrower notch portions to increase the concentrated stress, to thereby facilitate the generating of the initial cracks. However, the lengths of the narrower notch portion must be selected to be the optimum values for the following reason (a similar feature regarding initial cracks which will be described later). Incidentally, the term initial cracks refers to partially separated portions of the bottoms of the grooves of the narrower notch portions 41*b*, and the cracks start from the outboard ends of the narrower notch portions 41*b* and grow toward directions N to occupy the entire notched portion 41*a* (refer to FIG. 10).

In the illustrated embodiment, the entire length 41*f* of the notched portion (FIG. 8) is selected to be 20 mm. In this case, for example, if the lengths 14*g* of the narrower notch portions 41*b* are selected to be 1.5 mm, respectively, since the initial cracks are generated but the length of the wider notch portion 41*c* is relatively great, the initial cracks do not advance up to the center of the notched portion quickly, so that the number of bending reciprocations is increased (similar to the conventional techniques). On the other hand, if the lengths 14*g* of the narrower notch portions 41*b* are selected to be 7 mm, respectively, the lengths of the portions supporting the bending force are increased to disperse the stress, so that the cracks are hard to generate and a greater force must be applied to the grip 41. This is contrary to the object of the present invention and is not desirable. Thus, in the illustrated embodiment, the lengths 14*g* of the narrower notch portions 41*b* are selected to be 4–5 mm. In this case, the concentrated stress is increased and the initial cracks are apt to be generated with a small force. Further, regarding the length of the wider notch portion 41*c*, the initial cracks can easily reach the center of the notched portion with a smaller number of bending reciprocations of the grip 41, to thereby facilitate the separation of the grip 41.

Second Embodiment

Figure 11:
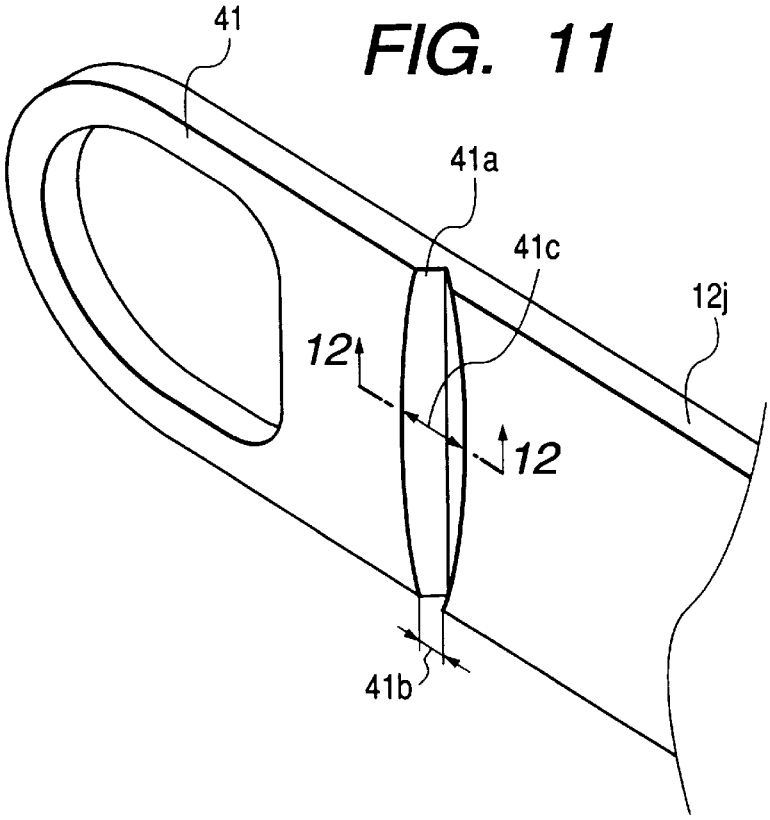
FIG. 11 is a perspective view of a grip according to a second embodiment of the present invention.

As shown in FIG. 11, a width of a notched portion 41*a* of a grip 41 is gradually decreased from a center of the notched portion to both ends thereof in a curved manner. With this configuration, narrower notch portions 41*b* are formed on both end portions of the notched portion of the grip 41 and a wider notch portion 41*c* is formed at a central portion of the notched portion. Incidentally, in FIG. 11, the tear tape (refer to FIG. 5) is omitted from illustration.

Figure 12:
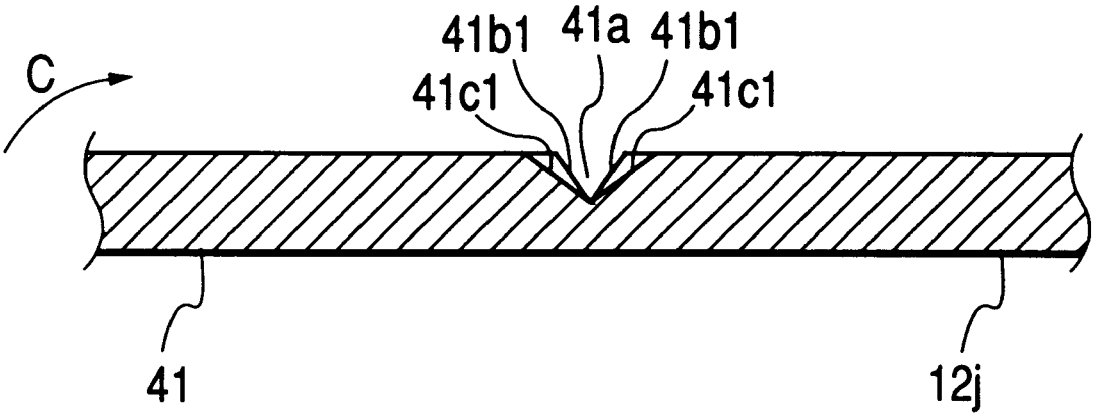
FIG. 12 is a sectional view taken along the line 12—12 in FIG. 11.

As shown in FIG. 12, the narrower notch portions 41*b* and the wider notch portion 41*c* are both constituted by V-shaped grooves, and the width of the open top of each narrower notch portion 41*b* is smaller than the width of the open top of the wider notch portion 41*c*, and, in the illustrated embodiment, the depth of each narrower notch portion 41*b* is the same as the depth of the wider notch portion 41*c* (however, the depth of each narrower notch portion 41*b* may not be the same as the depth of the wider notch portion 41*c*). The grip 41 is generally flat and the distance between the bottom of the groove of the notched portion and the opposite surface opposite to the surface in which the notched portion is formed is small.

Figure 13:
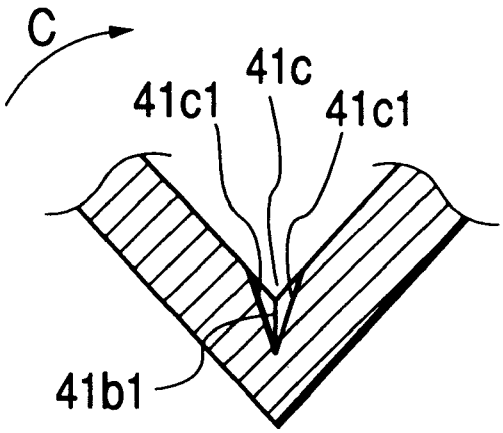
FIG. 13 is a sectional view taken along the line 12—12 in FIG. 11 showing a function of a portion shown in FIG. 11.

In the case where the grip 41 is separated from the toner frame 12*a*, in FIG. 12, when the grip 41 is bent toward the tear tape 43 (direction C), as shown in FIG. 13, opposed surfaces 41*b*1 of the V-shaped grooves of the narrower notch portions 41*b* (the grip 41 is made of synthetic resin so that surfaces of the V-shaped grooves are made flat by applying a force) abut against each other, but opposed surfaces 41*c*1 of the V-shaped groove of the wider notch portion 41*c* do not abut against each other. Thus, the flat surfaces 41*b*1 are formed in the narrower notch portions 41*b* on both width-wise ends of the grip 41 so that the stress is concentrated at the minimum thickness portions of the narrower notch portions 41*b*, to thereby facilitate the generation of the initial cracks and the easy growing of the cracks. With this arrangement, the separation of the toner seal grip 41 can easily be effected.

Third Embodiment

Figure 14:
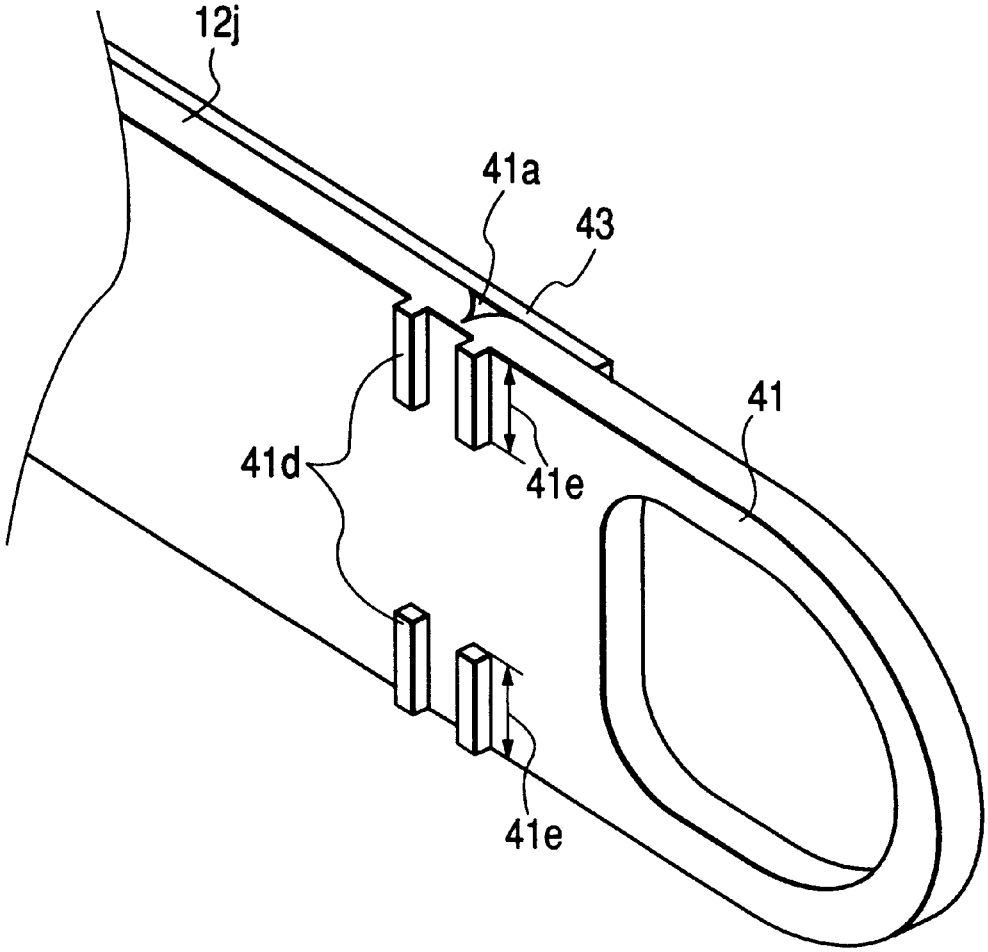
FIG. 14 is a perspective view of a grip according to a third embodiment of the present invention.

As shown in FIG. 14, thickened protruded portions 41*d* are formed on a portion (other than a width-wise central portion of a grip 41) of a surface of the grip 41 opposite to a surface in which a notched portion 41*a* is formed (in FIG. 14, the protection member for the hole of the grip is omitted from illustration).

The thickened protruded portions 41*d* extend in parallel with the V-shaped notched portion 41*a* and are disposed on both sides of a plane perpendicular to the plane of FIG. 14 and passing through a width-wise center line of the V-shaped notched portion 41*a* and are constituted by two rectangular projections. In the illustrated embodiment, the thickened protruded portions 41*d* are disposed symmetrically with respect to the V-shaped notched portion 41*a* and the two rectangular projections have the same cross-section. However, the configuration of the rectangular projections is not limited to the illustrated one. The cross-sectional configuration of the two thickened protruded portions 41*d* the height of each thickened protruded portion and the distance between the thickened protruded portions) is selected so that concentrated stress generated in the minimum thickness portion at the bottom of the V-shaped groove of the notched portion 41*a* during an operation which will be described later exceeds the fracture stress of the material of the grip 41.

Figure 15:
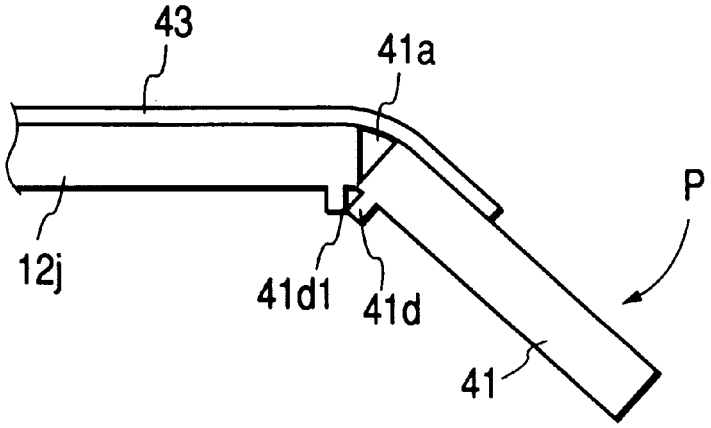
FIG. 15 is a schematic sectional view showing a condition in which the grip according to the third embodiment is laid.

In the case where the grip 41 is separated from the toner frame 12*a*, as shown in FIG. 15, when the grip 41 is bent toward a surface opposite to a surface to which the tear tape 43 is adhered (direction P), corners 41*d*1 of the thickened protruded portions 41*d* abut against each other. Consequently, concentrated stress is locally generated in the minimum thickness portion at the bottom of the V-shaped groove of the notched portion 41*a* of the grip 41, to thereby promote growth of the cracks for separation. Due to the local concentrated stress, external forces (moment around the abutted corners 41*d*1 of the thickened protruded portions 41*d*) are applied to the minimum thickness portion at the bottom of the V-shaped groove of the notched portion 41*a* on both width-wise ends of the grip 41, to thereby generate bending stress mainly including tensile stress. The shorter the lengths 41*e* of the thickened protruded portions 41*d* the greater the concentrated stress, to thereby facilitate the generation of the initial cracks. In this way, the separation of the toner seal grip 41 can be facilitated.

Fourth Embodiment

Figure 16:
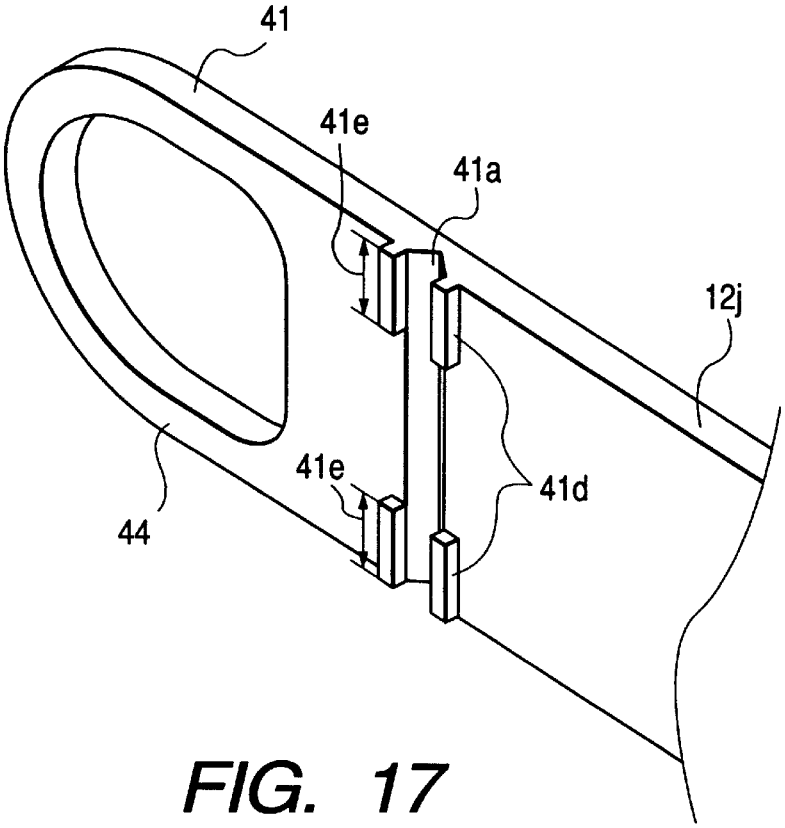
FIG. 16 is a perspective view of a grip according to a fourth embodiment of the present invention.

As shown in FIG. 16, the thickened protruded portions 41*d* may be formed on the surface in which the notched portion 41*a* is formed. Incidentally, the tear tape 43 and the protection member 44 are omitted from illustration (refer to FIG. 5).

Figure 17:
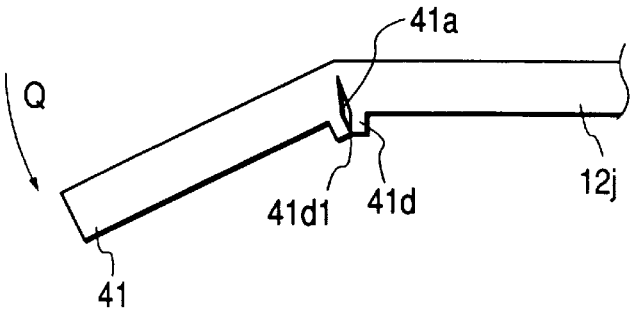
FIG. 17 is a schematic sectional view showing a condition in which the grip according to the fourth embodiment is laid.

In this case, as shown in FIG. 17, in the case where the grip 41 is separated from the flange 12*j* of the toner frame 12*a*, when the grip 41 is bent toward the surface in which the notched portion 41*a* is formed (direction Q), the corners 41*d*1 of the thickened protruded portions 41*d* abut against each other. Consequently, concentrated stress is locally generated in the minimum thickness portion at the bottom of the V-shaped groove of the notched portion 41*a* of the grip 41, to thereby promote the growth of the cracks for separation. Due to the local concentrated stress, external forces (moment around the abutted corners 41*d*1 of the thickened protruded portions 41*d*) are applied to the minimum thickness portion at the bottom of the V-shaped groove of the notched portion 41*a* on both width-wise ends of the grip 41, to thereby generate bending stress mainly including tensile stress. The shorter the lengths 41*e* of the thickened protruded portions 41*d*, the greater the concentrated stress, to thereby facilitate the generation of the initial cracks. In this way, the separation of the toner seal grip 41 can be facilitated.

The fourth embodiment is effective particularly when the material of the grip 41 has greater elongation with respect to an external force. That is to say, the minimum thickness portion at the bottom of the V-shaped groove of the notched portion 41*a* reaches the fracture stress by the external force to be torn. In this case, the greater the angle (exceeding 90 degrees) for rotating the grip 41 around the notched portion 41*a* until the notched portion 41*a* is torn, the greater the operability is made worse. However, when the heights of the thickened protruded portions 41*d* as it is in the illustrated embodiment, the minimum thickness portion at the bottom of the V-shaped groove of the notched portion 41*a* can easily extended, so that the angle for rotating the grip 41 around the notched portion 41*a* until the notched portion 41*a* is torn, can be selected to optimum. Consequently, the operability can be improved and the thickness of the grip 41 can be reduced.

Fifth Embodiment

Figure 18:
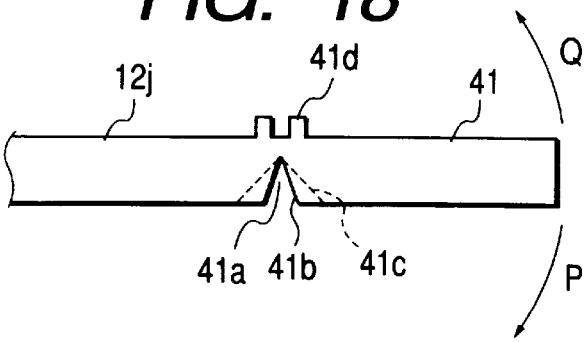
FIG. 18 is a side view of a grip according to a fifth embodiment of the present invention.
Figure 19:
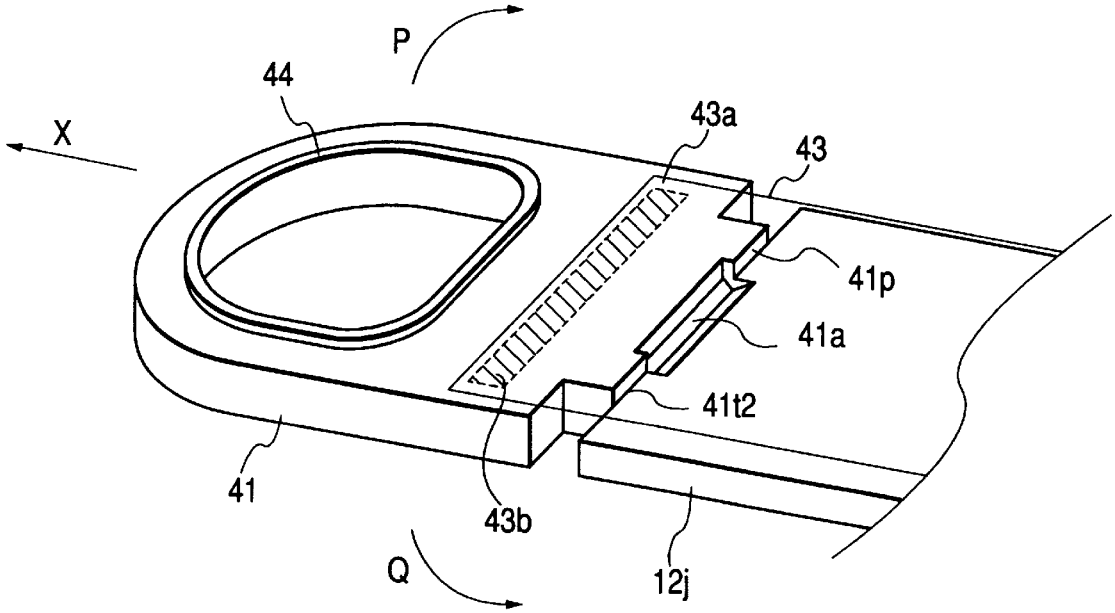
FIG. 19 is a perspective view of a toner seal drawing grip according to a sixth embodiment of the present invention.
Figure 20:
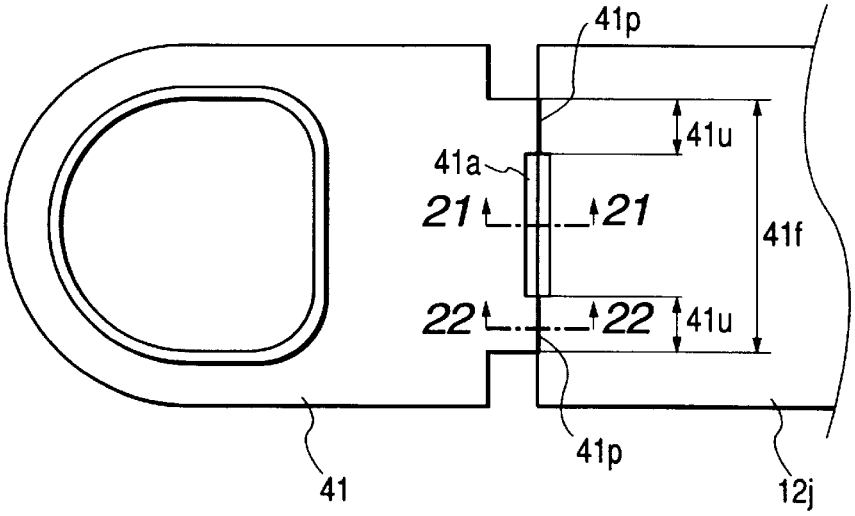
FIG. 20 is a front view of the grip of FIG. 19.

As shown in FIG. 18, a portion of a notched portion 41*a* for separating a grip 41 may be narrower than the remaining portion of the notched portion and thickened protruded portions 41*d*, having the same length as that of the narrower portion, may be provided (in parallel with the narrower portion) on the opposite surface opposite to the surface in which the notched portion is formed. In this embodiment, the thickened protruded portions 41*d* are provided on the opposite surface opposite to the surface in which the notched portion is formed, in correspondence to the narrower notch portions 41*b* of the notched portion 41*a* according to the first or second embodiment. In this case, when the grip 41 bent either in a direction P or in a direction Q, concentrated stress is generated in the narrower notch portions 41*b* or in the bottoms of the narrower notch portions 41*b* between the thickened protruded portions 41*d*, to thereby facilitate the growth of the initial cracks.

Sixth Embodiment

Figure 21:
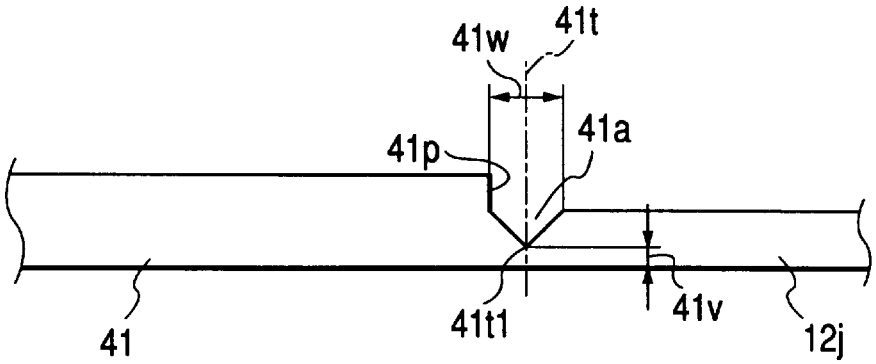
FIG. 21 is a sectional view taken along the line 21—21 in FIG. 20.
Figure 22:
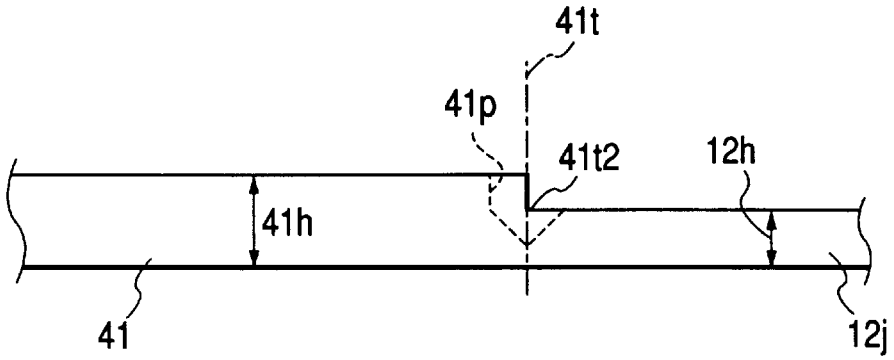
FIG. 22 is a sectional view taken along the line 22—22 in FIG. 20.

In an example shown in FIGS. 19 to 24A and 24B (the tear tape is omitted from illustration), the thickness of a grip 41 differs from the thickness of the flange 12*j* of the toner frame 12*a* so that a stepped portion 41*p* is defined therebetween, and a notched portion 41*a* is formed in a part of the stepped portion 41*p*. As shown in FIG. 21, the notched portion 41*a* is constituted by a V-shaped groove and is formed in a surface to which the tear tape 43 is adhered.

The grip 41 is formed from a substantially flat plate connected to the flange 12*j* of the toner frame 12*a* via the notched portion 41*a* and the stepped portion 41*p*. The distance (minimum thickness) between the bottom of the V-shaped groove of the notched portion 41*a* and the opposite surface of the grip 41, opposite to the surface in which the notched portion is formed, is small.

Figure 23:
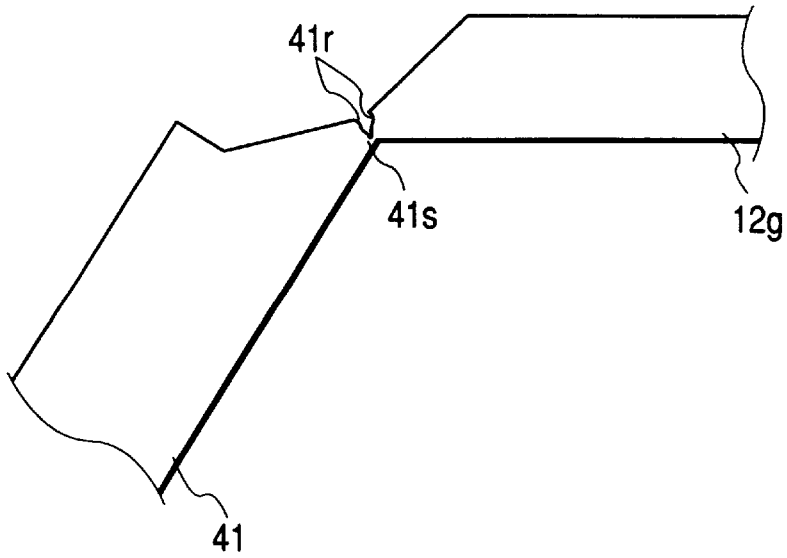
FIG. 23 is a sectional view taken along the line 21—21 in FIG. 20 showing a function of a portion shown in FIG. 20.

With the arrangement as mentioned above, the notched portion 41*a* is previously bent by about 90 degrees toward the opposite surface (direction Q in FIG. 19) during the packing of the process cartridge. However, at this point, the grip 41 is not separated from the toner frame 12*a*, and, as shown in FIGS. 23 and 24, only a crevice 41*r* is formed at a junction 41*t* (FIG. 21) between the grip 41 and the flange 12*j* of the toner frame 12*a*, but the grip is still connected to the flange via the minimum thickness portion 41*s*.

Figure 24A:
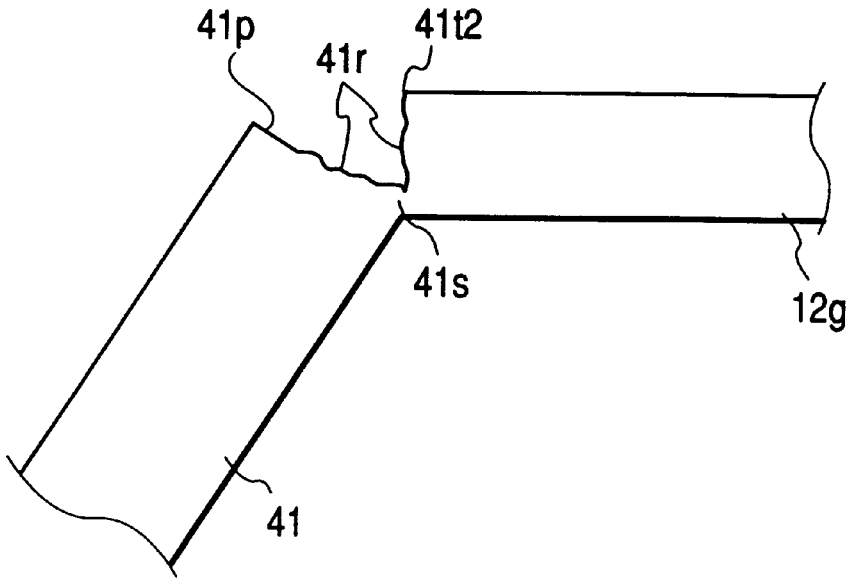
FIGS. 24A and 24B are views showing a function of a portion shown in FIG. 22.
Figure 24B:
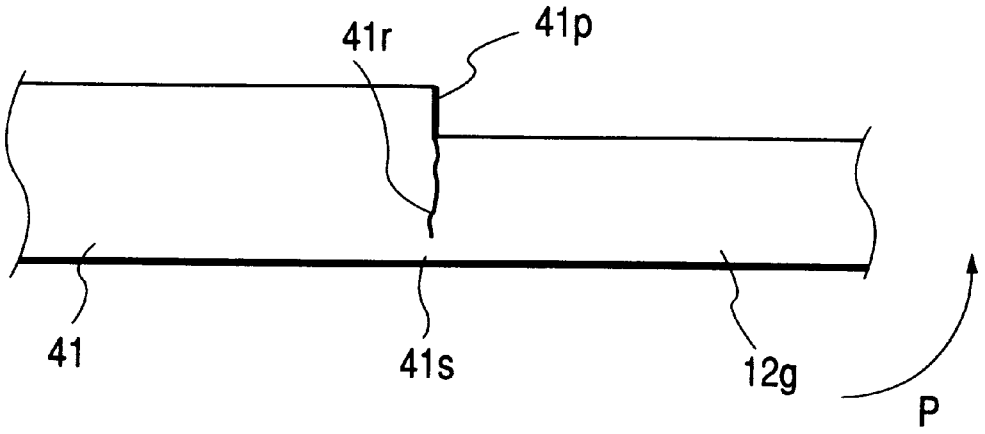

At the point when the grip 41 is previously bent toward the direction Q, as shown in FIGS. 24A and 24B, substantially flat crevice surfaces 41*r* are generated from a corner 41*t*2 of the stepped portion 41*p*. In use, in the condition shown in FIG. 24A, when the operator bents the grip toward the notched portion (direction P), as shown in FIG. 24B, the crevice surfaces 41*r* abut against each other. From this condition, the grip is further bent toward the direction P, the crevice surfaces 41*r* are compressed so that a great tension force is applied to the minimum thickness portion 41*s*, thereby creating the initial crack in the minimum thickness portion 41*s* of the stepped portion 41*p*. Since a central portion (at the minimum thickness portion 41*s* of the notched portion 41*a* in FIG. 23) is subjected to some tension force, the initial crack created in the minimum thickness portion 41*s* of the stepped portion 41*p* advances to the central portion.

In the notched portion having the uniform cross-section as is in the conventional technique, the minimum thickness portion is subjected to the tension force after the grip is bent to close the open top. To the contrary, in the illustrated embodiment, since the angle of the open top becomes substantially zero, the grip 41 can be separated by a small bending action. With this arrangement, the operability for unsealing the toner seal is improved.

Although the shorter a length 41*u* of the stepped portion 41*p* the greater the concentrated stress so that the initial crack is apt to be generated, if the length of the stepped portion is too short, the initial crack in the minimum thickness portion 41*s* does not reach up to the central portion, so that the number of bending reciprocations becomes substantially the same as that in the conventional technique. On the other hand, the length 41*u* of the stepped portion 41*p* is too long or if the junction is constituted by a uniform stepped portion 41*p* (not shown), although the separation of the grip 41 can easily be effected as explained above, since the bending force applied to the grip 41 is increased. This is contrary to the object of the present invention and is not desirable. That is to say, the length 41*u* of the stepped portion 41*p* is required to be selected to be an optimum in consideration of the improvement of the unsealing operability.

The thickness 41*v* of the minimum thickness portion at the bottom of the groove of the notched portion 41*a* is selected in consideration of the molten flow during the molding operation and the prevention of damage of the minimum thickness portion due to shock during the transportation, and a width 41*w* of the open top of the notched portion 41*w* is selected in consideration of the endurance limit during the molding operation. Further, it is preferable that a surface between a corner 41*t*2 of the stepped portion of the flange 12*j* side and the bottom 41*t*2 of the notched portion 41*a* should not be curved to promote the initial crack when the grip 41 is previously bent during the packaging of the process cartridge. If impossible, it is desirable that the radius of curvature of such a surface be made a minimum.

In the embodiment shown in FIGS. 19 to 24A and 24B, the thickness of the grip 41 is selected to be 2.5 mm, the thickness 12*h* of the flange 12*j* of the toner frame 12*a* is selected to be 1.5 mm, the thickness of the minimum thickness portion at the groove of the notched portion 41*a* is selected to be 0.5 mm, the entire length of the portion to be separated is selected to 20 mm, the length 41*u* of the stepped portion is selected to 4.5 mm, and the width 41*w* of the open top of the notched portion is selected to be 2 mm. Incidentally, the fact that the grip 41 is previously bent aids in reducing the package of the process cartridge for transportation.

Other Embodiments

Figure 25:
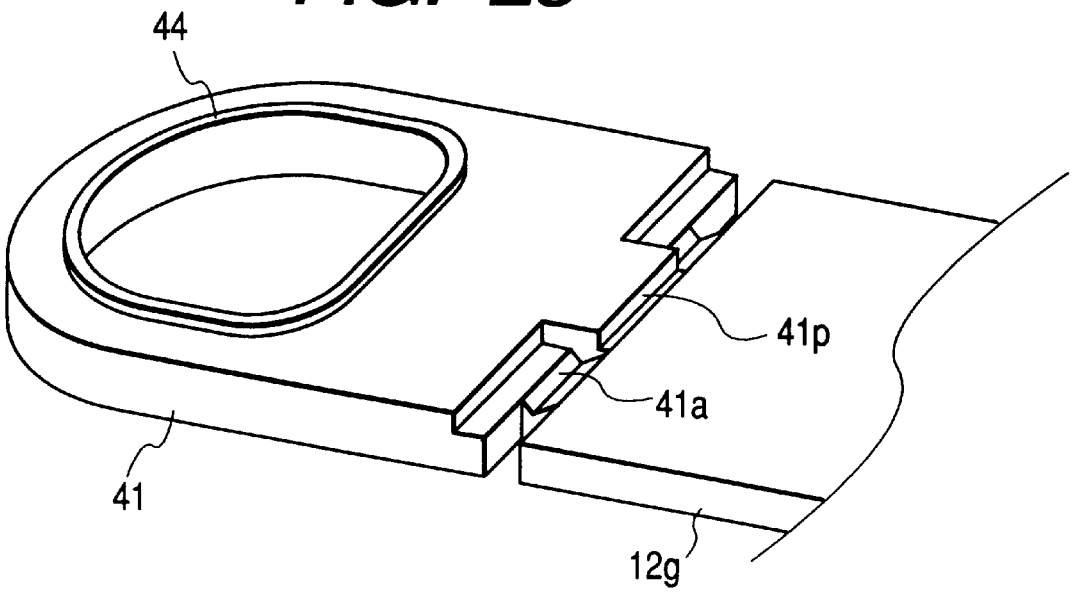
FIG. 25 is a perspective view of a grip according to the other embodiment of the present invention.

As shown in FIG. 25 (tear tape is omitted from illustration), a stepped portion 41*p* may be formed at a central portion of the portion to be separated and notched portions 41*a* may be formed in both width-wise ends of the portion to be separated. Further, a grip may not be provided with a hole into which the finger of the operator is inserted during the unsealing of the toner seal. Further, when the grip is previously bent to reduce the package of the process cartridge for transportation, the configurations of any one of the first to sixth embodiments is provided on the side opposite from the bending direction.

In the above-mentioned embodiments, the flange 12*g* is provided on the toner frame 12*a* and the toner seal grip is integrally connected to the flange 12*j*. However, the grip may be integrally formed with the developing frame or a cover 16*a* (refer to FIG. 2) for supporting a member near the toner frame (such as the toner agitating member 10*b*1) or a drive device 16 (such as the toner feed member 10*b*2 or the developing roller 10*d*). That is to say, the grip may be integrally formed with any member of the developing frame.

While an example that the process cartridge B serves to form a mono-color image was explained, in a process cartridge, a plurality developing means are provided to form a plural color image (for example, two-color image, three-color image or full-color image). Further, as a developing method, a known two-component magnet brush developing method, a cascade developing method, a touch-down developing method, or a cloud developing method may be used.

The electrophotographic photosensitive member is not limited to the above-mentioned photosensitive drum but may be constituted as follows. A photo-conductive material may be used as the photosensitive layer. The photo-conductive material may be, for example, amorphous silicone, amorphous selenium, zinc oxide, titanium oxide or organic photo-conductor (OPC). The photosensitive layer may be mounted on a rotary member such as a drum or belt, or on a sheet. In general, the drum or the belt is used. In the photosensitive member of drum type, the photo-conductive layer is deposited or coated on an aluminum cylinder.

In the first embodiment, while an example that the charge means of the so-called contact charging type is used was explained, other conventional charging means in which a tungsten wire is enclosed by a metal (for example, aluminium) shield on three sides and positive or negative ions generated by applying a high voltage to the tungsten wire are transferred to the surface of the photosensitive drum to uniformly charge the surface of the photosensitive drum may be used. The charging means may be of a blade type (charging blade), a pad type, a block type, a rock type or a wire type, as well as a roller type.

The cleaning means for removing the residual toner remaining on the photosensitive drum may be of the fur brush type or a magnet brush type, other than the above-mentioned cleaning means.

The process cartridge includes the electrophotographic photosensitive member and the developing means, and at least one other process means. Accordingly, the process cartridge may incorporate therein the electrophotographic photosensitive member, the developing means and the charge means as a cartridge unit which can detachably be mounted to the image forming apparatus, or may incorporate therein the electrophotographic photosensitive member and the developing means as a cartridge unit which can detachably be mounted to the image forming apparatus, or may incorporate therein the electrophotographic photosensitive member, the developing means and the cleaning means as a cartridge unit which can detachably be mounted to the image forming apparatus. That is to say, the process cartridge may incorporate therein the charge means or the cleaning means, and the electrophotographic photosensitive member and the developing means as a cartridge unit which can detachably be mounted to the image forming apparatus, or may incorporate therein at least one of the charge means or the cleaning means, and the electrophotographic photosensitive member and the developing means as a cartridge unit which can detachably be mounted to the image forming apparatus, or may incorporate therein at least the developing means and electrophotographic photosensitive member as a cartridge unit which can detachably be mounted to the image forming apparatus.

In the above-mentioned embodiments, while an example that the laser beam printer is embodied as the image forming apparatus was explained, the present invention is not limited to such an example but can be applied to an electrophotographic copying machine, an electrophotographic facsimile or an electrophotographic word processor, for example.

As mentioned above, according to the present invention, the grip can easily be separated from the supporting portion supporting the grip.

What is claimed is:

1. A developing unit for developing a latent image formed on an electrophotographic photosensitive member, comprising:

(a) a developing member for developing the latent image formed on the electrophotographic photosensitive member with a developer;

(b) a developer containing member for containing the developer;

(c) a supply opening provided in said developer containing member and for supplying the developer contained within said developer containing member to said developing member;

(d) a seal member for sealably sealing said supply opening;

(e) a grip member connected to said seal member to be gripped when said supply opening is opened;

(f) a support portion for supporting said grip member, said grip member being separable from said support portion by bending said grip member with respect to said support portion; and (g) a first abutment portion and a second abutment portion abutting against each other when said grip member is bent with respect to said support portion to locally generate great stress along a longitudinal direction of a separation portion at which said grip member is separated from said support portion.

2. A developing unit according to claim 1, further comprising a central groove and a plurality of end grooves, wherein said central groove is formed at a central portion of said separation portion in the longitudinal direction thereof, wherein said end grooves each have a width smaller than a width of said central groove, wherein said end grooves are formed at one and other end portions in the longitudinal direction of said separation portion, and wherein said first and second abutment portions are constituted by opposed first and second surfaces of said end grooves.

3. A developing unit according to claim 1, further comprising a groove having a continuously changing width from one end to the other end of said separation portion formed in said separation portion, and wherein said first and second abutment portions are constituted by opposed first and second surfaces of a narrower portion of said groove.

4. A developing unit according to claim 3, wherein a width of said groove is narrow at one and other longitudinal end portions of said separation portion and is wide at a central portion of said separation portion.

5. A developing unit according to claim 1, further comprising a groove, extending from one end to the other end of said separation portion, formed in said separation portion, and a first protrusion and a second protrusion opposed to each other formed adjacent to one and other end portions in the longitudinal direction of said separation portion, on a surface opposite to a surface in which said groove is formed, wherein said first and second abutment portions are constituted by opposed first and second surfaces of said first and second protrusions.

6. A developing unit according to claim 1, further comprising a groove, extending from one end to the other end in the longitudinal direction of said separation portion, formed in said separation portion, and a first protrusion and a second protrusion opposed to each other formed adjacent to both longitudinal end portions of said separation portion, on a surface in which said groove is formed, wherein said first and second abutment portions are constituted by opposed first and second surfaces of said first and second protrusions.

7. A developing unit according to claim 1, further comprising:

a groove, formed at a central portion of said separation portion in a longitudinal direction thereof, and cracks formed at one and other end portions in the longitudinal direction of said separation portion;

wherein upon forming said grip member, said grip member is integrally provided with protruded portions formed at one and other longitudinal end portions of said separation portion protruding from said support portion in a thickness direction of said grip member;

wherein the cracks are generated by bending said grip member with respect to said support portion toward a direction opposite to a direction in which said grip member protrudes from said support portion; and said first and second abutment portions are constituted by a surface of said grip member and an opposed surface of said support portion at said cracks.

8. A developing unit according to claim 1, further comprising:

a crack formed at a middle portion of said separation portion in a longitudinal direction thereof, and grooves formed at one and other longitudinal end portions of said separation portion;

upon forming said grip member, said grip member is integrally provided with protruded portions formed at the middle portion of said separation portion protruding from said support portion in a thickness direction of said grip member;

wherein said crack is generated by bending said grip member with respect to said support portion toward a direction opposite to a direction in which said grip member protrudes from said support portion; and said first and second abutment portions are constituted by a surface of said grip member and an opposed surface of said support portion at said crack.

9. A developing unit according to claim 1, further comprising:

a middle groove formed at a middle portion of said separation portion in a longitudinal direction thereof and cracks formed at one and other end portions in the longitudinal direction of said separation portion; and a plurality of end grooves, wherein upon forming said grip member, said grip member and said support portion are integrally formed with each other with interposition of said end grooves, wherein said end grooves have a smaller width and a smaller depth than said middle groove, wherein said end grooves are positioned at one and other longitudinal end portions of said separation portion;

wherein said cracks are formed by bending said grip member with respect to said support portion toward a depth direction of said middle and end grooves; and said first and second abutment portions are constituted by a surface of said grip member and an opposed surface of said support portion at said cracks.

10. A developing unit according to claim 1, wherein said grip member includes a hole through which a finger of an operator can be inserted, and a protection member, made of resin, provided in said hole.

11. A developing unit according to one of claims 1 to 10, wherein said support portion, said grip member, and said first and second abutment portions are integrally molded from plastic material.

12. A developing unit according to one of claims 1 to 10, wherein said developer containing member, said support portion, said grip member, and said first and second abutment portions are integrally molded from plastic material.

13. A developing unit for developing a latent image formed on an electrophotographic photosensitive member, comprising:

(a) a developing member for developing the latent image formed on said electrophotographic photosensitive member with a developer;

(b) a developer containing member for containing the developer;

(c) a supply opening provided in said developer containing member for supplying the developer contained within said developer containing member to said developing member;

(d) a seal member for sealably sealing said supply opening;

(e) a grip member connected to said seal member and to be gripped when said supply opening is unsealed; and (f) a support portion for supporting said grip member, a crack being generated between said grip member and said support portion by bending said grip member toward a predetermined direction with respect to said support portion;

wherein, when said grip member is bent with respect to said support portion toward a direction opposite to said predetermined direction, a surface of said grip member and an opposed surface of said support portion abut against each other to locally generate great stress in a separation portion in which said grip member is separated from said support portion in a longitudinal direction thereof.

14. A developing unit according to claim 13, further comprising:

a groove, formed at a middle portion of said separation portion in a longitudinal direction thereof;

wherein said grip member has protruded portions formed at one and the other longitudinal end portions of said separation portion protruding from said support portion in a thickness direction of said grip member;

wherein said crack is formed by bending said grip member with respect to said support portion toward a direction opposite to a direction in which said protruded portions protrude; and wherein said surface of said grip member and said surface of said support portion at said crack are constituted by opposed first and second surfaces.

15. A developing unit according to claim 13, further comprising:

grooves formed at one and other longitudinal end portions of said separation portion;

wherein said grip member has protruded portions formed at the middle portion of said separation portion protruding from said support portion in a thickness direction of said grip member;

wherein said crack is formed by bending said grip member with respect to said support portion toward a direction opposite to a direction in which said grip member protrudes from said support portion; and wherein said surface of said grip member and said surface of said support portion at said crack are constituted by opposed first and second surfaces, respectively, wherein said opposed second surface is said opposed surface of said support portion abutting said surface of said grip member.

16. A developing unit according to claim 13, further comprising:

a first groove formed at a middle portion of said separation portion in a longitudinal direction thereof; and a second groove having a smaller width and a smaller depth than said first groove, formed at one and other longitudinal end portions of said separation portion;

wherein said crack is generated by bending said grip member with respect to said support portion toward a direction of the depth of said first and second grooves; and wherein said surface of said grip member and said opposed surface of said support portion at said crack are constituted by opposed first and second surfaces.

17. A developing unit according to claim 13, wherein said grip member has a hole therein through which a finger of an operator can be inserted, and a protection member, made of resin, is positioned in said hole.

18. A developing unit according to one of claims 13 to 17, wherein said support portion, said grip member, and first and second abutment portions are integrally molded with plastic material.

19. A developing unit for developing an electrostatic image formed on an image bearing member with a developer, comprising:

(a) a developer bearing member provided on a developing frame body for bearing and conveying the developer to a developing position on the image bearing member;

(b) a developer container for containing the developer;

(c) a seal member provided sealably on a supply opening which supplies the developer from said developer container to the developing frame body;

(d) a grip portion connected to said seal member to be gripped when said seal member is opened;

(e) a support portion for supporting said grip portion, said grip portion being separable from said support portion at a separation portion; and (f) a first abutment portion and a second abutment portion abutting against each other, and a first non-abutment portion and a second non-abutment portion not abutting against each other, which are provided at a position different from the position of said first and second abutment portions in a longitudinal direction of the separation portion, when said grip portion is bent with respect to said support portion at the separation portion to be separated from said support portion at the separation portion.

20. A developing unit according to claim 19, further comprising a first groove formed at a central portion of the separation portion in the longitudinal direction thereof, and a second groove having a width smaller than a width of said first groove, formed at an end portion in the longitudinal direction of the separation portion, and wherein said first and second abutment portions are constituted by opposed first and second surfaces of said second groove, and wherein said first and second non-abutment portions are constituted by opposed third and fourth surfaces of said first groove.

21. A developing unit according to claim 20, wherein said first and second grooves are a portion of a groove having a width changing continuously along the longitudinal direction of the separation portion.

22. A developing unit according to claim 19, further comprising a groove formed along the longitudinal direction of the separation portion, and a first protrusion and a second protrusion opposed to each other, which are formed adjacent to a longitudinal end portion of the separation portion, on a surface opposite to a surface on which the groove is formed, and wherein said first and second abutment portions are constituted by said first and second protrusions.

23. A developing unit according to claim 19, further comprising a groove formed along the longitudinal direction of the separation portion, and a first protrusion and a second protrusion opposed to each other which are formed adjacent to a longitudinal end portion of the separation portion, on a surface on which the groove is formed, and wherein said first and second abutment portions are constituted by said first and second protrusions.

24. A developing unit according to claim 19, further comprising a groove formed at a central portion of said separation portion in the longitudinal direction thereof and cracks formed at an end portion in the longitudinal direction of the separation portion by bending said grip portion with respect to said support portion toward a direction opposite to a direction in which said grip portion protrudes from said support portion, and wherein said first and second abutment portions are constituted by a crack surface on a grip portion side and oppose a crack surface on a support portion side, at said cracks.

25. A developing unit according to claim 19, further comprising a groove formed at an end portion of said separation portion in the longitudinal direction thereof and cracks, formed at a central portion in the longitudinal direction of said separation portion, by bending said grip portion with respect to said support portion toward a direction opposite to a direction in which said grip portion protrudes from said support portion, and wherein said first and second abutment portions are constituted by a crack surface on a grip portion side and oppose a crack surface on a support portion side, at said cracks.

26. A developing unit according to claim 19, wherein said support portion, said grip portion, said first and second abutment portions and said first and second non-abutment portions are integrally molded.

27. A developing unit according to claim 19, wherein said seal member is provided in a direction in which said grip portion is bent with respect to said support portion at said separation portion to be separated from said support portion at the separation portion.

28. A developing unit according to claim 19, wherein said grip portion is provided so as to be crossed with respect to said support portion by a predetermined angle when said grip portion is bent with respect to said support portion at the separation portion to be separated from said support portion at the separate portion.

29. A process cartridge detachably attachable to an image forming apparatus comprising:

an image bearing member; and a developing unit for developing an electrostatic image formed on said image bearing member with a developer, including:

(a) a developer bearing member provided on a developing frame body for bearing and conveying the developer to a developing position on the image bearing member;

(b) a developer container for containing the developer;

(c) a seal member provided sealably on a supply opening which supplies the developer from said developer container to the developing frame body;

(d) a grip portion connected to said seal member to be gripped when said seal member is opened;

(e) a support portion for supporting said grip portion, said grip portion being separable from said support portion at a separation portion; and (f) a first abutment portion and a second abutment portion abutting against each other, and a first non-abutment portion and a second non-abutment portion not abutting against each other, which are provided at a position different from a position of said first and second abutment portions in a longitudinal direction of the separation portion, when said grip portion is bent with respect to said support portion at the separation portion to be separated from said support portion at the separation portion.

30. A process cartridge according to claim 29, further comprising a first groove formed at a central portion of the separation portion in the longitudinal direction thereof, and a second groove having a width smaller than a width of said first groove formed at an end portion in the longitudinal direction of the separation portion, and wherein said first and second abutment portions are constituted by opposed first and second surfaces of said second groove, and wherein said first and second non-abutment portions are constituted by opposed third and fourth surfaces of said first groove.

31. A process cartridge according to claim 30, wherein said first and second grooves are a portion of a groove having a width changing continuously along the longitudinal direction of the separation portion.

32. A process cartridge according to claim 29, further comprising a groove formed along the longitudinal direction of the separation portion, and a first protrusion and a second protrusion opposed to each other and formed adjacent to a longitudinal end portion of the separation portion, on a surface opposite to a surface on which the groove is formed, and wherein said first and second abutment portions are constituted by said first and second protrusions.

33. A process cartridge according to claim 29, further comprising a groove formed along the longitudinal direction of the separation portion, and a first protrusion and a second protrusion opposed to each other and formed adjacent to a longitudinal end portion of the separation portion, on a surface on which the groove is formed, and wherein said first and second abutment portions are constituted by said first and second protrusions.

34. A process cartridge according to claim 29, further comprising a groove formed at a central portion of said separation portion in a longitudinal direction thereof and cracks formed at an end portion in the longitudinal direction of the separation portion by bending said grip portion with respect to said support portion toward a direction opposite to a direction in which said grip portion protrudes from said support portion, and wherein said first and second abutment portions are constituted by a crack surface on a grip portion side and oppose a crack surface on a support portion side, at said cracks.

35. A process cartridge according to claim 29, further comprising a groove formed at an end portion of said separation portion in a longitudinal direction thereof and cracks formed at a central portion in the longitudinal direction of said separation portion by bending said grip portion with respect to said support portion toward a direction opposite to a direction in which said grip portion protrudes from said support portion, and wherein said first and second abutment portions are constituted by a crack surface on a grip portion side and oppose a crack surface on a support portion side, at said cracks.

36. A process cartridge according to claim 29, wherein said support portion, said grip portion, said first and second abutment portions and said first and second non-abutment portions are integrally molded.

37. A process cartridge according to claim 29, wherein said seal member is provided in a direction in which said grip portion is bent with respect to said support portion at said separation portion to be separated from said support portion at the separation portion.

38. A process cartridge according to claim 29, wherein said grip portion is provided so as to be crossed with respect to said support portion by a predetermined angle when said grip portion is bent with respect to said support portion at the separation portion to be seperated from said support portion at the seperation portion.

39. A process cartridge according to one of claims 29 to 38, wherein said image bearing member is an electrophotographic photosensitive member.

* * * * *